US009767781B2

(12) United States Patent
Miller

(10) Patent No.: US 9,767,781 B2
(45) **Date of Patent: *Sep. 19, 2017**

(54) DETACHABLE WHISTLE

(71) Applicant: Ronald L. Miller, Portland, OR (US)

(72) Inventor: Ronald L. Miller, Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/337,439

(22) Filed: Oct. 28, 2016

(65) Prior Publication Data

US 2017/0047058 A1 Feb. 16, 2017

Related U.S. Application Data

(63) Continuation of application No. 15/078,239, filed on Mar. 23, 2016, now Pat. No. 9,514,731.

(60) Provisional application No. 62/138,879, filed on Mar. 26, 2015.

(51) Int. Cl.
*G10K 5/00* (2006.01)
*G10K 11/00* (2006.01)

(52) U.S. Cl.
CPC ..... *G10K 5/00* (2013.01); *G10K 11/004* (2013.01)

(58) Field of Classification Search
CPC ..... G10K 5/00; G10K 5/02
USPC ..... 116/137 R; 446/204, 205, 206, 216
See application file for complete search history.

(56) References Cited

U.S. PATENT DOCUMENTS 303,139 A 8/1884 Farnham
1,548,628 A 11/1921 Petrie
2,217,514 A 3/1938 Henry
2,697,642 A 12/1954 Rudy
2,731,663 A 1/1956 Thompson
2,947,456 A 8/1960 Seron
3,120,213 A 2/1964 Mulligan
3,302,566 A 2/1967 Blanchet
(Continued)

FOREIGN PATENT DOCUMENTS

CN 203706659 7/2014
FR 875517 9/1942
(Continued)

OTHER PUBLICATIONS

Notice of Allowance for related U.S. Appl. No. 15/078,239, 8 pages, dated Oct. 3, 2016.

(Continued)

*Primary Examiner* — R. A. Smith
(74) *Attorney, Agent, or Firm* — Klarquist Sparkman, LLP

(57) ABSTRACT

Disclosed technology allows a whistle to be magnetically detachable from a base portion, such as a finger grip. Some embodiments comprise a whistle component comprising a first magnetic member and a base component comprising a second magnetic member, such that the first and second magnetic members are magnetically attracted to each other. The whistle component can be detachable from the base component by breaking a magnetic bond between the first and second magnetic members. At least one of the first and second magnetic members can be at least partially covered by a non-magnetic material such that the non-magnetic material separates the first and second magnetic members when the whistle component is magnetically coupled to the base component. The first magnetic member can be contained within a cavity of an adaptor that is attached to the whistle, or within the whistle itself.

19 Claims, 23 Drawing Sheets

(56) References Cited

U.S. PATENT DOCUMENTS

| | | | |
|---|---|---|---|
| 4,392,325 | A | 7/1983 | Woronets |
| 4,700,655 | A | 10/1987 | Kirby |
| 4,769,624 | A | 9/1988 | Merritt et al. |
| 5,002,006 | A | 3/1991 | Ehrenreich |
| 5,391,184 | A | 2/1995 | Rosenthal |
| 5,515,808 | A | 5/1996 | Edlund |
| 5,816,186 | A | 10/1998 | Shepherd |
| 6,109,490 | A | 8/2000 | Caluori |
| 6,112,330 | A | 9/2000 | Bryan |
| 6,305,656 | B1 | 10/2001 | Wemyss |
| 6,416,379 | B1 | 7/2002 | Topman |
| D462,917 | S | 9/2002 | Hills et al. |
| D555,529 | S | 11/2007 | Foxcroft et al. |
| 7,618,013 | B2 | 11/2009 | Elmer et al. |
| 7,624,457 | B2 | 12/2009 | Sedlmair et al. |
| D621,290 | S | 8/2010 | Foxcroft |
| D621,734 | S | 8/2010 | Hills et al. |
| D622,172 | S | 8/2010 | Hills et al. |
| 8,028,642 | B2 | 10/2011 | Foxcroft |
| 8,069,810 | B2 | 12/2011 | Petzl et al. |
| 8,220,188 | B1 | 7/2012 | Keller |
| 8,398,155 | B2 | 3/2013 | Andochick |
| 8,550,235 | B2 | 10/2013 | Suderman |
| 8,950,727 | B2 | 2/2015 | Skudelny |
| 9,514,731 | B2 * | 12/2016 | Miller ..... G10K 5/00 |
| 2003/0033970 | A1 | 2/2003 | Hills et al. |
| 2004/0200236 | A1 | 10/2004 | Emberson et al. |
| 2005/0082323 | A1 | 4/2005 | O'Hair |
| 2006/0171092 | A1 | 8/2006 | Corcoran et al. |
| 2009/0087672 | A1 | 4/2009 | Miwa et al. |
| 2010/0080087 | A1 | 4/2010 | Shupp |
| 2010/0089151 | A1 | 4/2010 | Mantilla et al. |
| 2011/0056437 | A1 | 3/2011 | Sprung |
| 2011/0083254 | A1 | 4/2011 | Trutna et al. |
| 2011/0214597 | A1 | 9/2011 | Foxcroft |
| 2012/0148991 | A1 | 6/2012 | Coutlee |

FOREIGN PATENT DOCUMENTS

| | | |
|---|---|---|
| JP | 02069652 | 3/1990 |
| JP | 2006-042842 | 2/2006 |
| JP | 2009-063977 | 3/2009 |
| JP | 2010-256484 | 11/2010 |

OTHER PUBLICATIONS

Office Action for related U.S. Appl. No. 15/078,239, 19 pages, dated Jun. 24, 2016.

* cited by examiner

DETACHABLE WHISTLE

CROSS-REFERENCE TO RELATED APPLICATIONS

This application is a continuation of U.S. patent application Ser. No. 15/078,239, filed on Mar. 23, 2016, which claims the benefit of U.S. Provisional Application No. 62/138,879, filed on Mar. 26, 2015, both of which are incorporated by reference herein in their entirety.

FIELD

This disclosure relates to whistles, particularly whistles used by referees during sporting events, such as finger whistles and whistles that can be detached from and reattached to a base portion.

BACKGROUND

A whistle is typically used by referees, umpires and other officials in various sports, events, and games to signal the start and stop of action and announce penalties or goals. Traditional sports whistles range in style and type. Some have a metal body or case with a ball inside and are called a pea whistle. Others have a plastic body with sound chambers and are called "pea-less" whistles. Many whistles can be held in the hand or have an attached ring that can be clipped to a lanyard or tied to a string. Lanyards are typically worn around the neck but some are knotted and held in the hand or worn on the wrist. Other whistles, referred to as "finger whistles" are permanently attached to a ridged, but bendable metal bracelet type sleeve that is typically contoured to be worn around or clamped to the index and middle fingers.

To use a whistle attached to a lanyard worn around the neck, an umpire or official must first locate it with a free hand, grasp it in the free hand, position it in the free hand, and insert it into the mouth.

An advantage of a lanyard mounted whistle is that after inserting the whistle in the mouth, both hands are free to signal a foul or goal or to direct play while the whistle is being blown.

An advantage of a finger whistle or sleeve mounted whistle is that because of its fixed position on the fingers, it is quickly accessible and the free hand is simply moved to the mouth and the whistle inserted the mouth.

A disadvantage of using a finger whistle is that it requires that the umpire leave the hand close to the mouth while blowing the whistle which prevents the use of the hand and arm for the purpose of signaling a foul or announcing a goal while the whistle is being blown.

It is possible to remove the sleeve and whistle from the bare fingers with the mouth, however when a finger whistle is worn on a gloved hand, the process of removing it with the mouth is sometimes difficult or impossible and requires the hand to remain near the mouth or the use of the other hand to remove the whistle and sleeve from the gloved finger. This process delays the use of the hand or hands for signaling or directing play.

Another advantage of a whistle attached to a lanyard and worn around the neck is that after blowing the whistle, it permits the user to simply release the whistle from the mouth and let it drop, knowing that it is retained by the lanyard.

Another disadvantage of the sleeve mounted finger whistle that has been removed from the fingers and held in the mouth, is that after blowing, it is sometimes difficult or impossible to place the sleeve back on the fingers or gloved fingers using just the mouth and sometimes requires the use both hands to reinstall it back on the fingers. When this occurs it must be held in the mouth until both the hands are free. If the whistle is held in the mouth, the large sleeve and whistle makes it difficult to talk and verbally direct play or announce the foul especially if the hands are in use catching a ball or replacing a flag or restraining a player.

While the lanyard mounted whistle is convenient to use and does not encumber the hands once located and inserted in the mouth, it is sometimes difficult to locate and grasp in the hand while running since it is free to swing around the neck and occasionally flips over the shoulder or becomes tangled on clothing, a pen in the front pocket of a shirt or jacket, or an ear.

A sleeve mounted finger whistle is quickly accessible however it encumbers one hand during use and is difficult to remove from the fingers with the mouth should the hand and fingers be needed.

A whistle simply held in the hand, or a whistle attached to a lanyard and held in the hand, or a whistle attached to a lanyard designed to be worn around the wrist all share similar advantages or disadvantages of the lanyard mounted whistle worn around the neck or the finger sleeve mounted whistle.

SUMMARY

Disclosed herein are embodiments of devices comprising a whistle that is magnetically held to a sleeve, such as a finger sleeve, and that is detachable from the finger sleeve by breaking the magnetic bond, such as by pulling on the whistle with the mouth while holding the sleeve with a hand, and reattachable to the finger sleeve by re-engaging the magnetic bond. Also disclosed are components of such devices and methods related to such devices.

The whistle can have a permanently attached or affixed magnet that holds it to a metallic finger sleeve or a non-metallic finger sleeve with a metallic component, or the whistle can have a permanently attached or affixed metallic component that holds to a magnet that is permanently attached or affixed to a finger sleeve, or the whistle and/or the finger sleeve can comprise one or more magnets. The terms "permanently affixed," "permanently attached," "permanently adhered," "affixed," "attached," "adhered," and similar terms as used herein mean connected, either directly or using one or more intermediate components or substances, in such a way so as to be not readily disconnectable during ordinary use (e.g., by pulling the whistle with the mouth or while the user is running), but possibly disconnectable using a tool (e.g., a screwdriver) and/or with sufficient brute force, and the terms include the use of an adhesive or a mechanical fastener to connect components together, as opposed to the use of a readily detachable magnetic attraction to temporarily couple components together.

Some embodiments comprise a separate component or adapter comprising a magnet or metallic component permanently attached or affixed that is contoured to fit over and/or be attached to an existing whistle (such as a Fox40® plastic whistle), thereby providing the same capability to be detached from a finger sleeve with the mouth.

The whistle can comprise an existing plastic whistle (such as a Fox 40® plastic whistle) that can be easily modified to receive a magnet or magnetic component that can be used in conjunction with a metallic finger sleeve or a non-metallic finger sleeve fitted with a metallic base or magnet that provides the same capability for the whistle to be detached from a finger sleeve, such as with the mouth.

Disclosed embodiments provide advantages of a conventional finger whistle, but eliminate the need to remove the finger sleeve portion from the fingers when the whistle portion is used in the mouth while the hands are not adjacent the mouth. Disclosed embodiments also provide advantages of a lanyard whistle by allowing quick access to the whistle without encumbering the hands and quick placement back on to the finger sleeve after use.

Also disclosed are adapters for magnetically coupling a whistle to a finger sleeve. The adapter can comprise a structural component configured to be affixed to either the whistle or the finger sleeve, and a magnet or a metallic component affixed to the structural component and configured to be magnetically coupled to the whistle or to the finger sleeve. In some embodiments, the adapter comprises a magnet that is configured to be magnetically coupled to a metallic component of the finger sleeve or to a metallic component affixed to the finger sleeve. In some embodiments, the adapter comprises a magnet that is configured to be magnetically coupled to the whistle, to a metallic component of the whistle, or to a metallic component affixed to the whistle.

Also disclosed are sleeve assemblies for detachably mounting a whistle. Such an assembly can comprise a sleeve component configured to fit around a portion of a hand, such as a finger sleeve, for holding the assembly with the hand, and a coupling component configured to detachably couple a whistle to the sleeve component via a magnetic bond. In some embodiments, the coupling component comprises a magnet. In some embodiments, the coupling component comprises a receiver that is configured to be affixed to or fit around a whistle to secure the whistle to the receiver. For example, the receiver and the sleeve component can be detachably couplable together via a magnetic bond.

In some disclosed embodiments, one or more magnets and/or magnetic materials are partially or fully encased or enclosed within a polymeric material, which can act to secure the magnets/magnetic materials to the respective component of the whistle assembly.

In some embodiments, the whistle and the adaptor component that holds one of the magnets and/or magnetic materials are integrally formed or are manufactured as a single unit. For example the whistle housing can include two halves that are fixed together during manufacturing, and the two halves can include a portion that forms a housing for one of the magnets, such that when the two halves are secured together they contain the magnet.

The foregoing and other objects, features, and advantages of the disclosed technology will become more apparent from the following detailed description, which proceeds with reference to the accompanying figures.

DETAILED DESCRIPTION

Figure 1A:
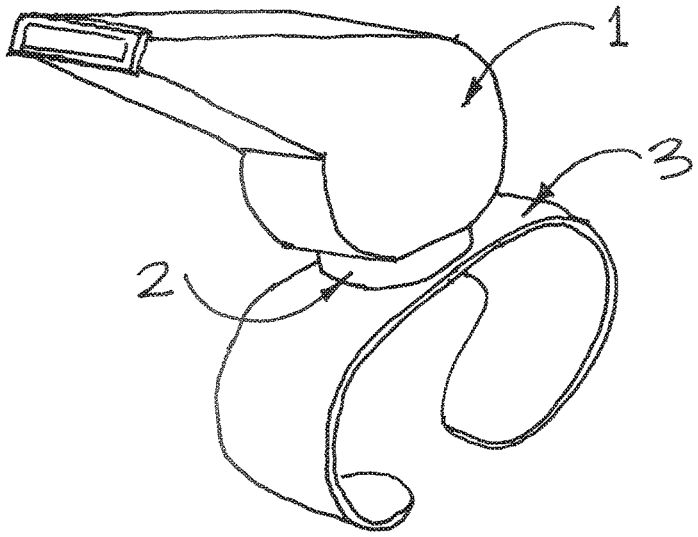
FIG. 1A illustrates in a perspective view an exemplary embodiment of a whistle permanently affixed to a magnet that is shown magnetically held or coupled to a separate finger sleeve that is made of a magnetically attractive metallic material.
Figure 1B:
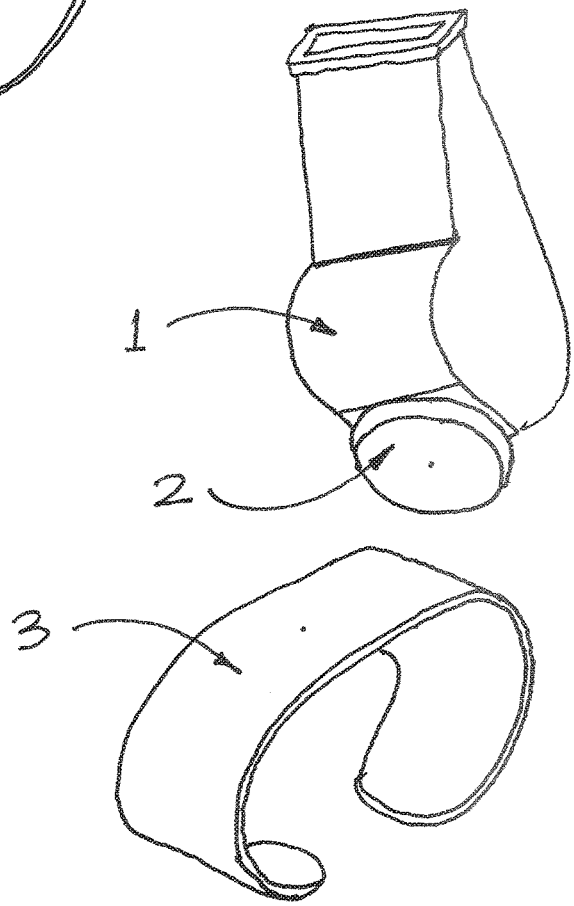
FIG. 1B illustrates in a perspective view the embodiment of FIG. 1A with the whistle and magnet detached from the separate finger sleeve.

As shown in FIGS. 1A and 1B, an exemplary embodiment can comprise a whistle 1, permanently affixed to a magnet 2, which permits the whistle to be temporarily held to the metallic finger sleeve, or grip, 3, until it is ready to be grasped, such as by the mouth, and detached from the sleeve, as shown in FIG. 1B, such that it can be blown when apart from the sleeve. After use, the whistle with the magnet affixed is easily placed back onto the metallically attractive sleeve component by moving the fingers with the sleeve to the mouth and placing the whistle back on the sleeve component. The whistle with the affixed or attached magnet is held in place on the sleeve by the attraction of the magnet to the metallic sleeve component until it is ready to be detached again.

Figure 2A:
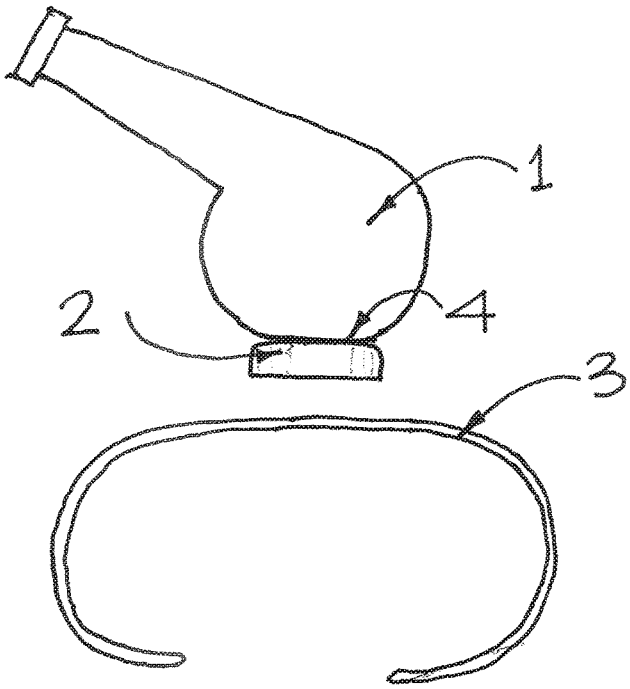
FIG. 2A is a side view of another embodiment having a whistle and adhered magnet and detached from the separate finger sleeve.
Figure 2B:
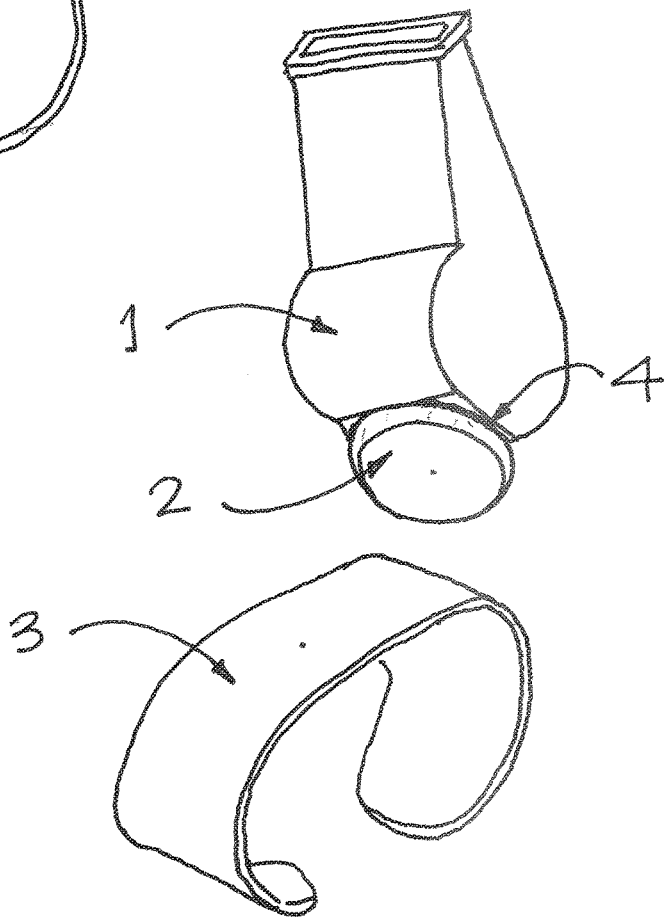
FIG. 2B is a perspective view of the embodiment of FIG. 2A showing the whistle and magnet detached from the separate finger sleeve.

FIG. 2A and FIG. 2B shows an embodiment wherein the magnet 2 is permanently adhered to the whistle body or case 1 with an adhesive 4, such as an epoxy or other product that provides permanent adhesion between the magnet and the body of the whistle.

Figure 3A:
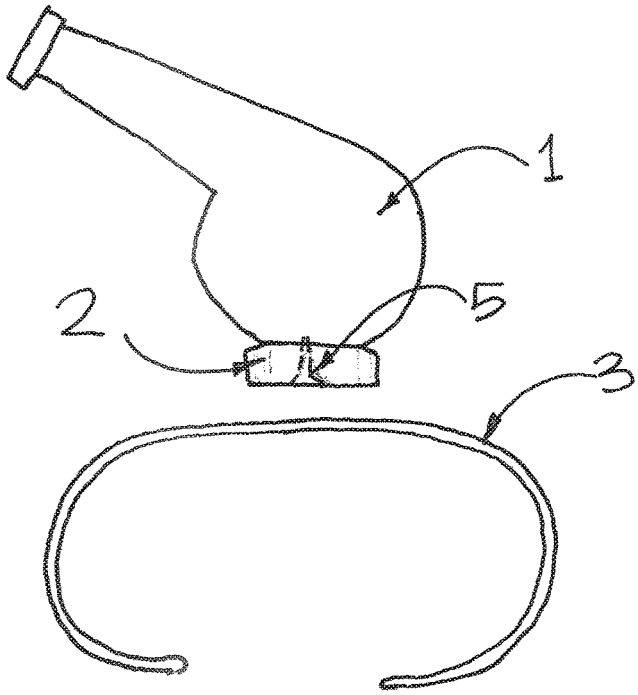
FIG. 3A is a side view of an embodiment having a whistle permanently attached to a magnet using a screw and shown detached from the separate metallic finger sleeve.
Figure 3B:
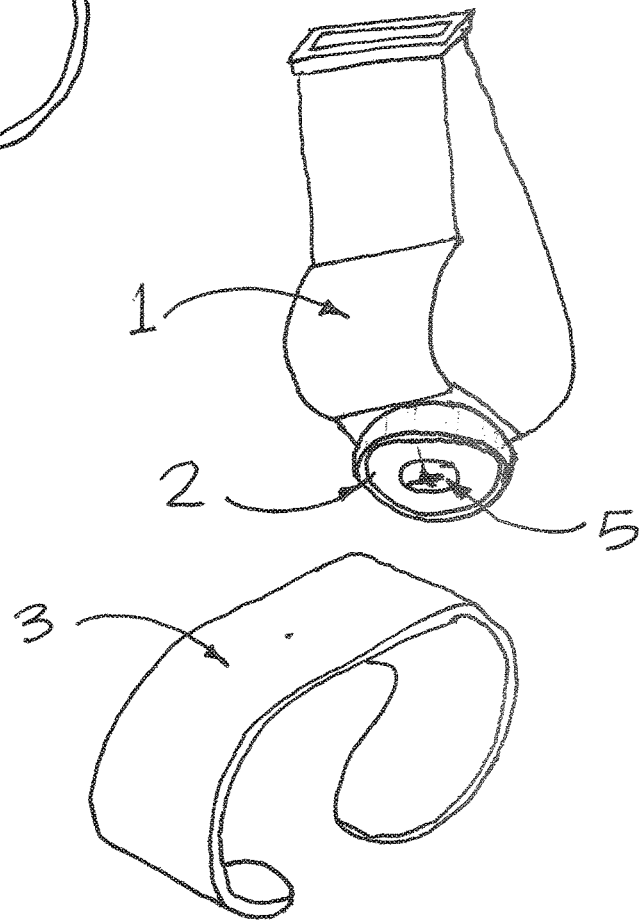
FIG. 3B is a perspective view of the embodiment of FIG. 3A with the whistle and magnet shown separated from the finger sleeve.

As shown in FIG. 3A and FIG. 3B, the magnet 2 can also be permanently affixed or connected to the whistle 1 with a mechanical fastener or connector 5, such as a screw, bolt or rivet.

Figure 4A:
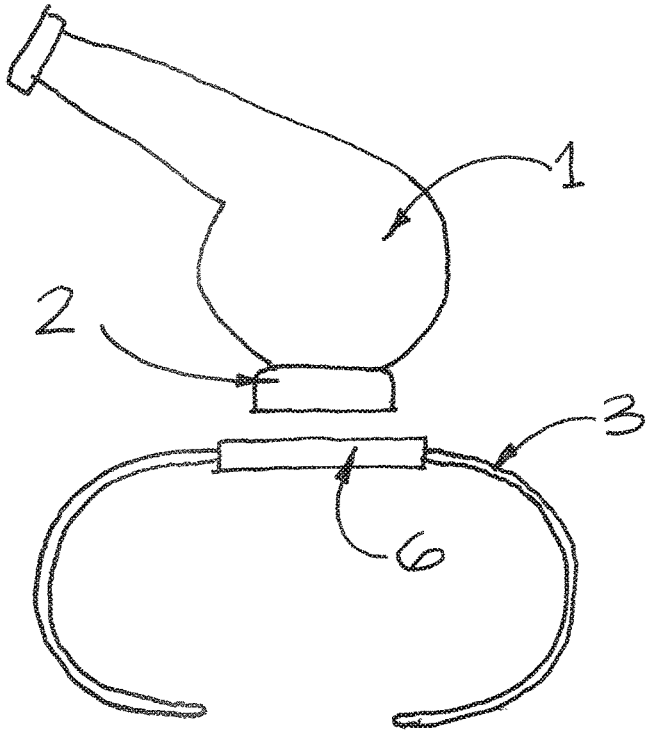
FIG. 4A is a side view of an embodiment having a whistle permanently attached or affixed to a magnet and shown detached or separated from a metallic or non-metallic finger sleeve that includes a metallic base or docking component.
Figure 4B:
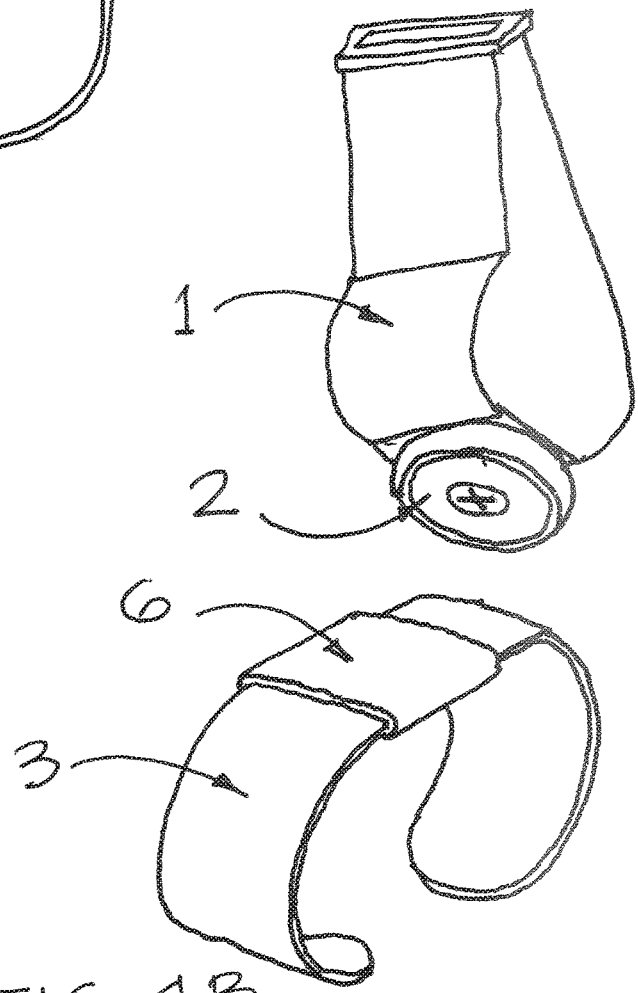
FIG. 4B is a perspective view of the embodiment of FIG. 4A.

FIG. 4A and FIG. 4B show an embodiment comprising a magnet 2 permanently attached or affixed to the whistle 1 and a magnetically attractive metallic base component 6 permanently affixed or attached to a metallic or non-metallic finger sleeve 3. The metallic base or docking component permits the finger sleeve to be constructed of magnetic or a variety of non-magnetic material, such as stainless steel, plastic, fiberglass, or other products.

Figure 5A:
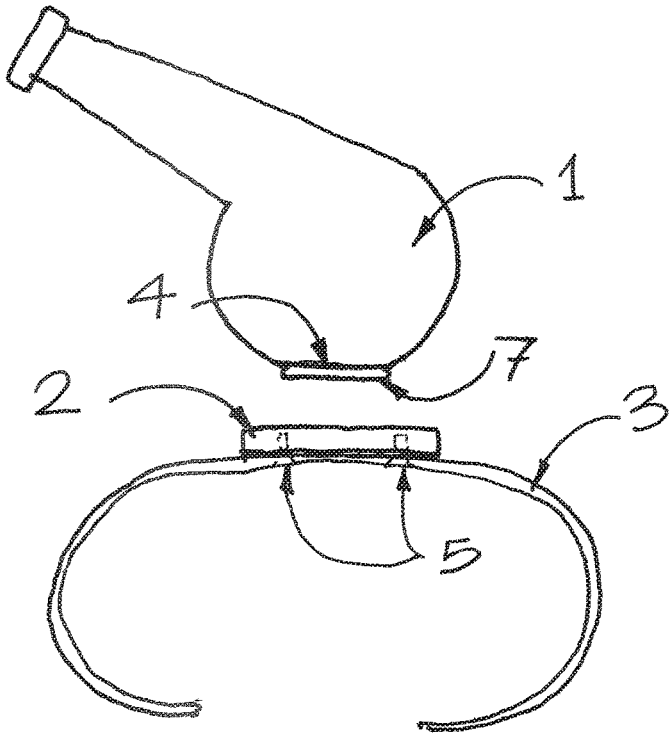
FIG. 5A is a side view of an embodiment having a whistle permanently attached or affixed to a metallic component and shown separated from a magnet that is permanently attached or affixed to a metallic or non-metallic finger sleeve.
Figure 5B:
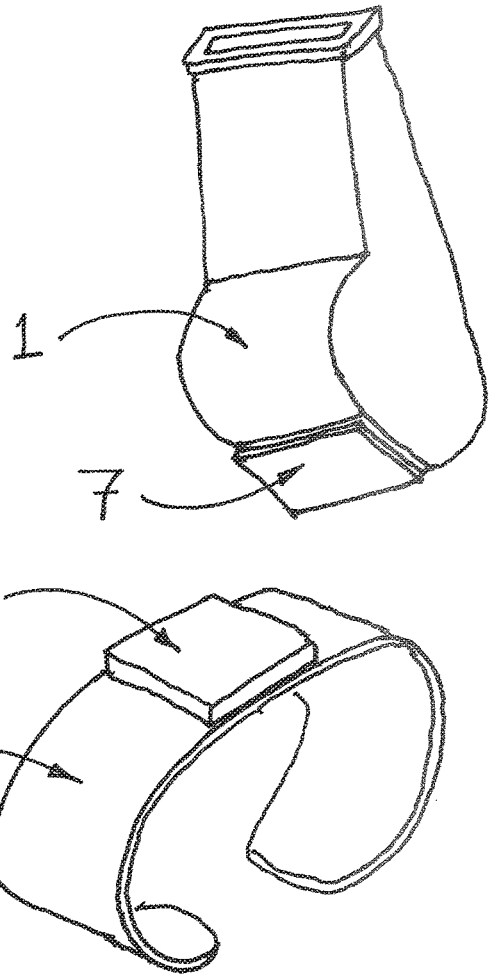
FIG. 5B is a perspective view of the embodiment of FIG. 5A.

FIG. 5A and FIG. 5B show an embodiment comprising a magnetically attractive metallic component 7 permanently attached to the whistle 1 and a magnet 2 permanently affixed or attached to the finger sleeve 3, which can be made of a magnetic or non-magnetic material.

Figure 6A:
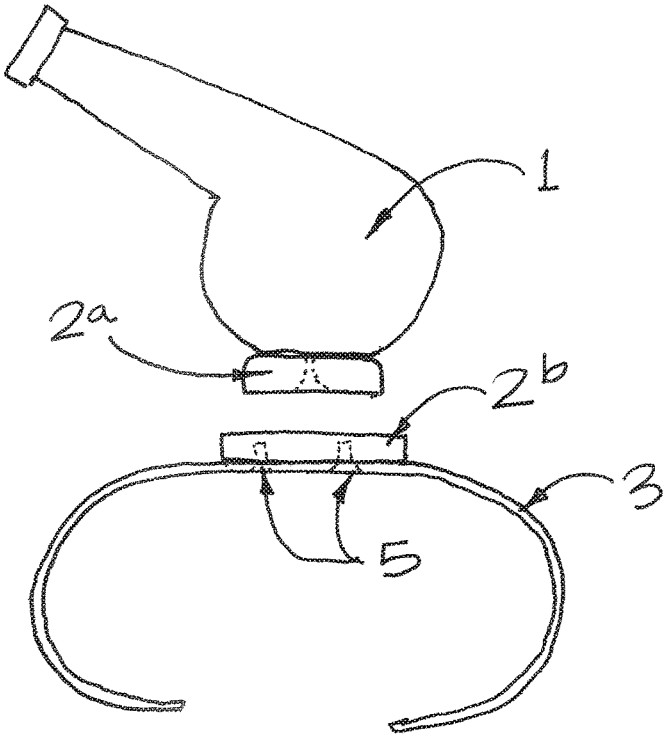
FIG. 6A is a side view of an embodiment having a whistle permanently attached or affixed to a magnet and shown separated from another magnet that is permanently attached or affixed to a finger sleeve.
Figure 6B:
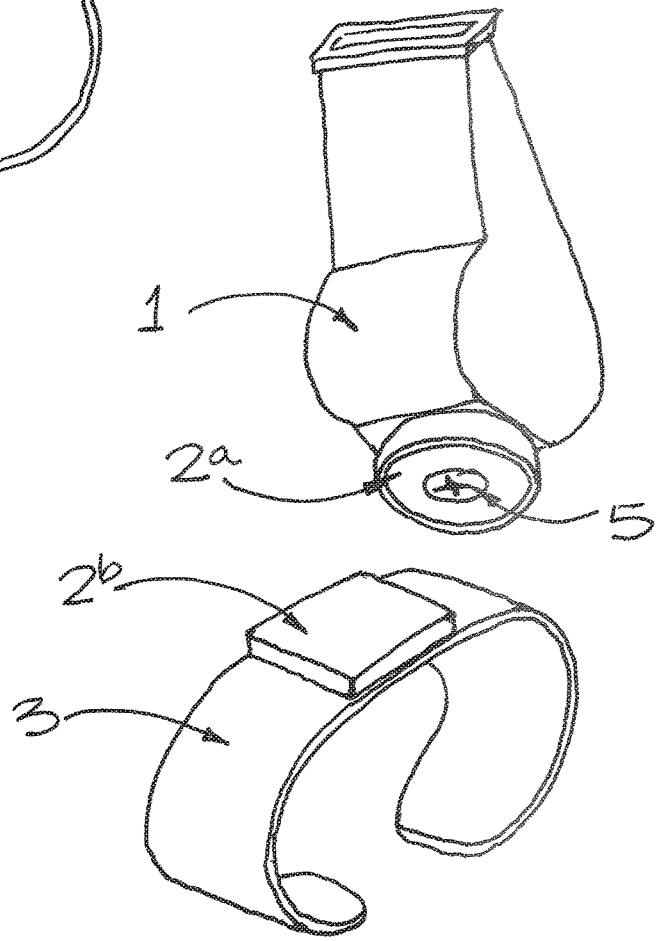
FIG. 6B is a perspective view of the embodiment of FIG. 6A.

FIG. 6A and FIG. 6B show an embodiment comprising a magnet 2*a* permanently attached or affixed to the whistle 1 and a second magnet 2*b* permanently affixed or attached to a finger sleeve 3, such as by fasteners 5 or otherwise. The sleeve 3 can be made of a magnetic or non-magnetic material.

Figure 7A:
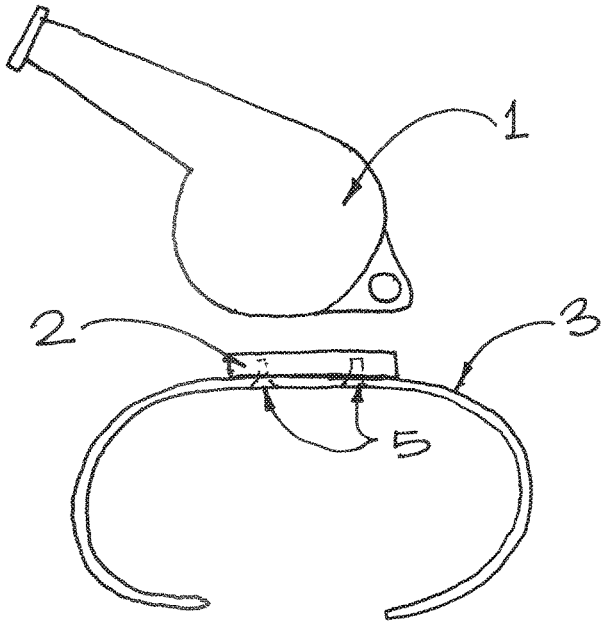
FIG. 7A is a side view of an embodiment having a magnetically attractive metallic whistle shown separated from a magnet that is permanently attached or affixed to a finger sleeve.
Figure 7B:
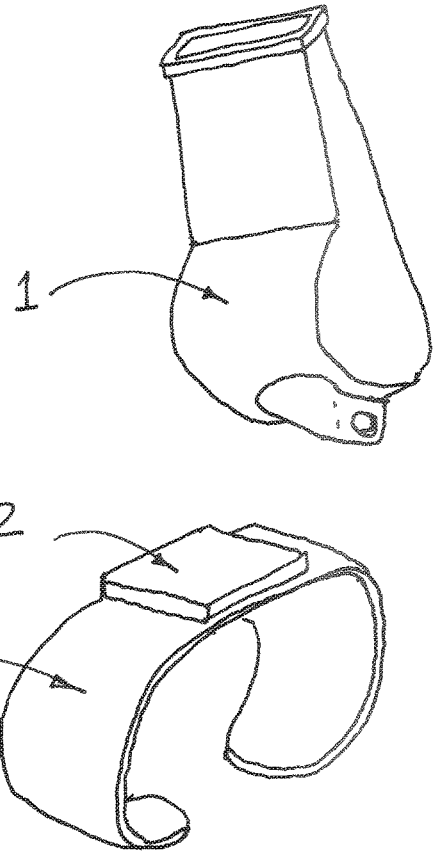
FIG. 7B is a perspective view of the embodiment of FIG. 7A.

FIG. 7A and FIG. 7B show an embodiment comprising a magnetically attractive metallic whistle 1 detachable from a magnet 2 permanently affixed or attached to a finger sleeve 3, such as by fasteners 5 or otherwise. The sleeve 3 can be made of a magnetic or non-magnetic material.

Figure 8A:
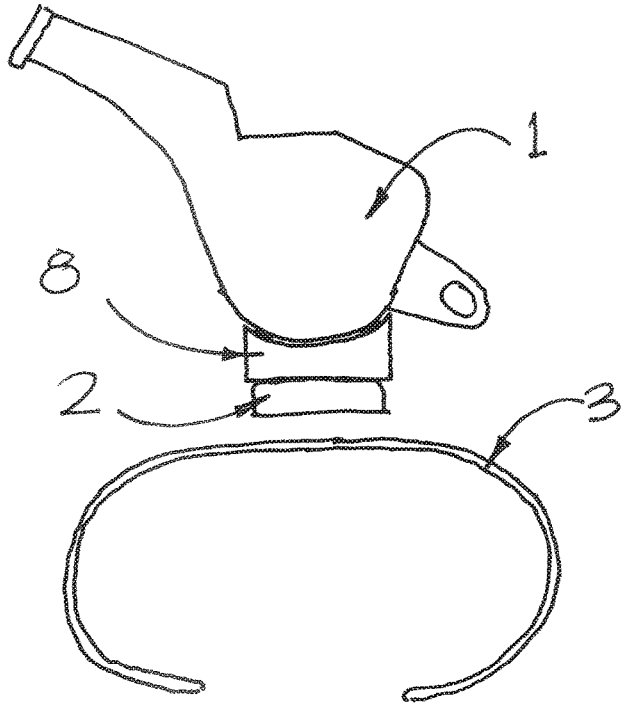
FIG. 8A is a side view of an embodiment having a whistle with an intermediate base pedestal that is permanently adhered or attached to a magnet, and the intermediate base pedestal is permanently adhered or attached to the whistle, and the magnet is detachable from a magnetically attractive metal finger sleeve.
Figure 8B:
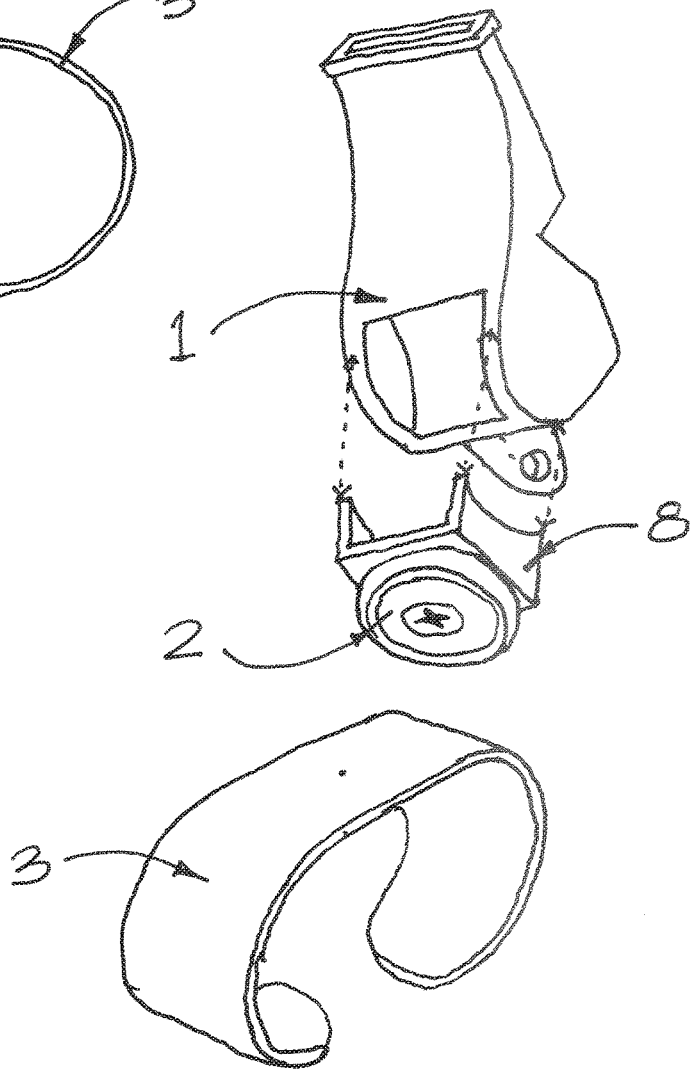
FIG. 8B is a perspective, partially-exploded view of the embodiment of FIG. 8A.
Figure 8C:
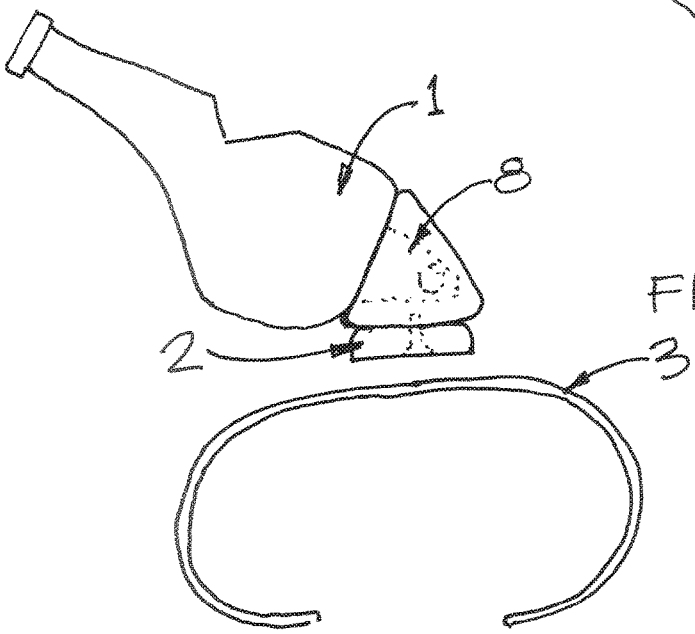
FIG. 8C is a side view of an alternative embodiment, similar to FIG. 8A, having a whistle with an intermediate base pedestal that is permanently adhered or attached to a magnet. The intermediate base pedestal is permanently adhered or attached to the whistle, and the magnet is detachable from a magnetically attractive metal finger sleeve.
Figure 8E:
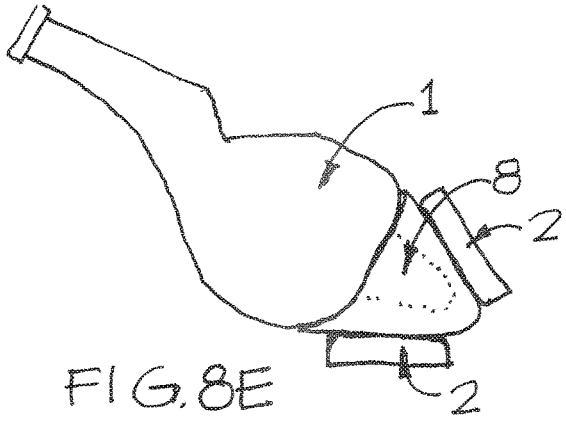
FIG. 8E is a side view of an alternative embodiment, similar to FIG. 8C, having a whistle with an intermediate base pedestal that is permanently adhered or attached to two or more separate magnets. The intermediate base pedestal is permanently adhered or attached to the whistle, and the magnets are independently, alternatively attachable to a magnetically attractive finger sleeve.
Figure 8D:
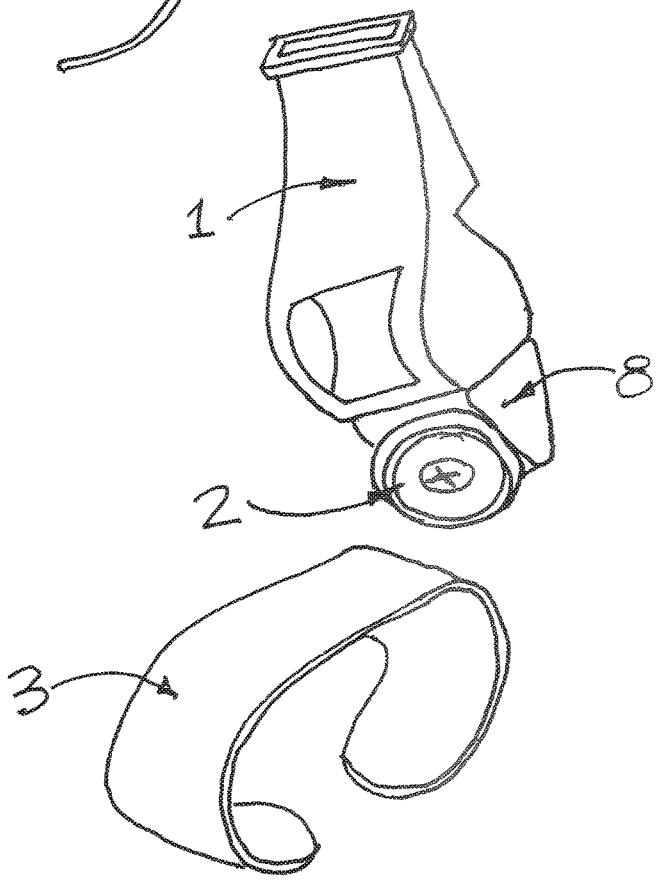
FIG. 8D is a perspective view of the embodiment of FIG. 8C.

FIGS. 8A-8E show embodiments comprising a magnet 2 permanently attached or affixed to an intermediate base component, or magnet holding component 8. The base component 8 can be contoured to fit the configuration of a part of an existing whistle 1 and can be permanently attached or affixed to the existing whistle. The base component 8 can have any suitable shape, such the embodiment shown in FIGS. 8A and 8B, or the embodiment shown in FIGS. 8C and 8D. As shown in FIG. 8E, the intermediate base component 8 can also be configured to include two or more magnets 2 to provide for docking the whistle in multiple directions on a sleeve. As shown in FIGS. 8A-8E, the intermediate base 8 can be permanently affixed to a whistle body 1 or the magnet can be integrated or cast into the body of the whistle component. The shape of the intermediate base component 8 can be cast into the form of a whistle or the whistle can be configured in a shape that includes a platform for mounting a magnet.

Figure 9A:
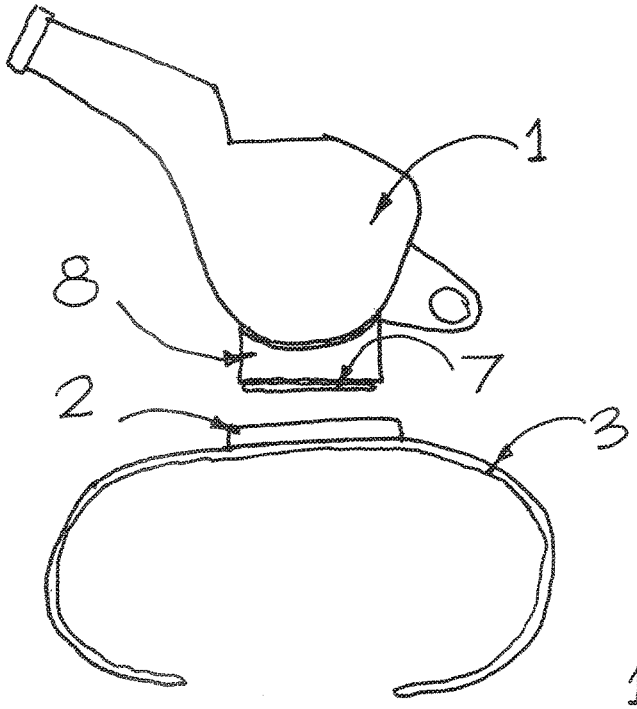
FIG. 9A is a side view of an embodiment having a whistle with an intermediate base pedestal that is permanently adhered or attached to a magnetically attractive metallic component and shown detached or separated from a separate finger sleeve with a magnet that is permanently attached or affixed to the finger sleeve. The intermediate base pedestal is permanently attached or affixed to the whistle.
Figure 9B:
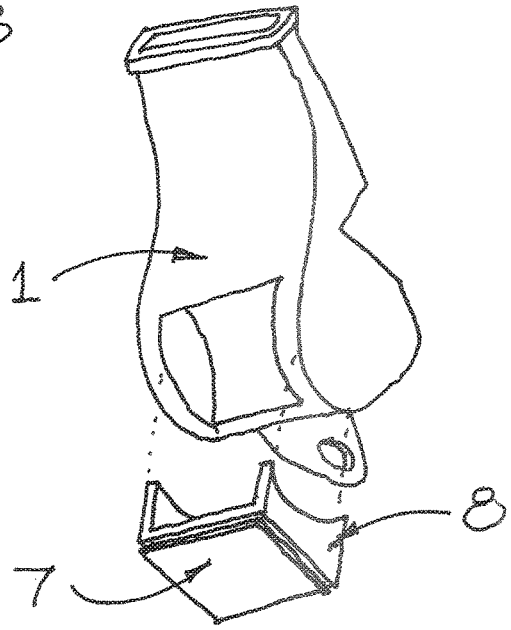
FIG. 9B is a perspective, partially-exploded view of the embodiment of FIG. 9A.
Figure 9B:
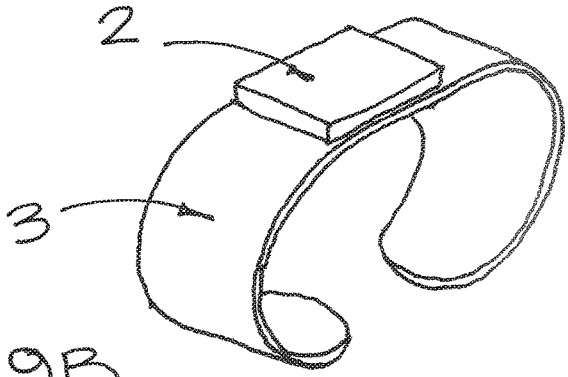
Figure 9C:
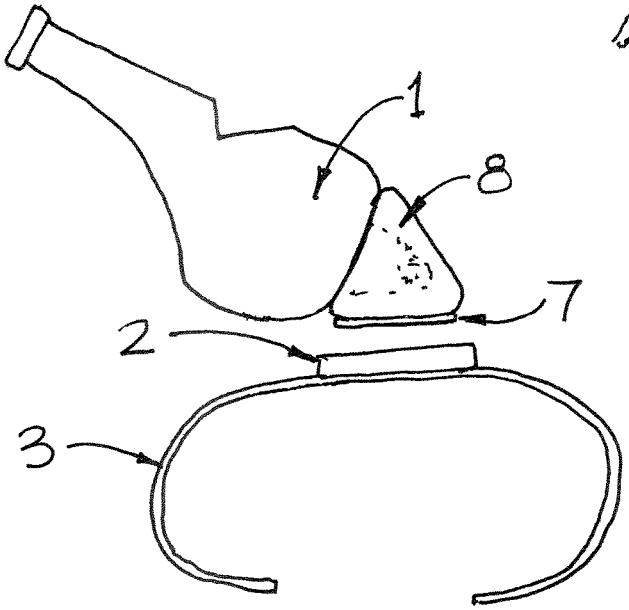
FIG. 9C is a side view of an alternative embodiment, similar to FIG. 9A, having a whistle with an intermediate base pedestal that is permanently adhered or attached to a magnetically attractive metallic component and shown detached or separated from a separate finger sleeve with a magnet that is permanently attached or affixed to the finger sleeve. The intermediate base pedestal is permanently attached or affixed to the whistle.
Figure 9E:
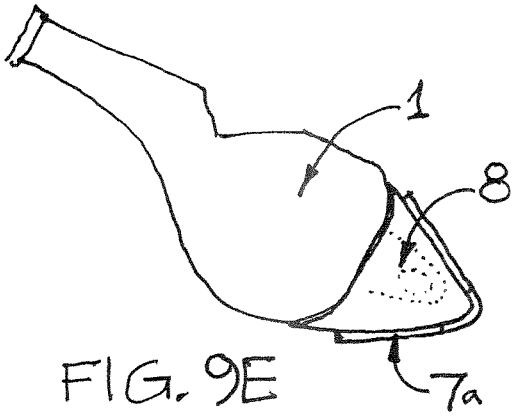
FIG. 9E is a side view of an alternative embodiment of a portion of the embodiment of FIG. 9C, having a whistle and an intermediate base pedestal that is permanently adhered or attached to a magnetically attractive metallic component that is positioned on multiple sides of the intermediate base pedestal.
Figure 9D:
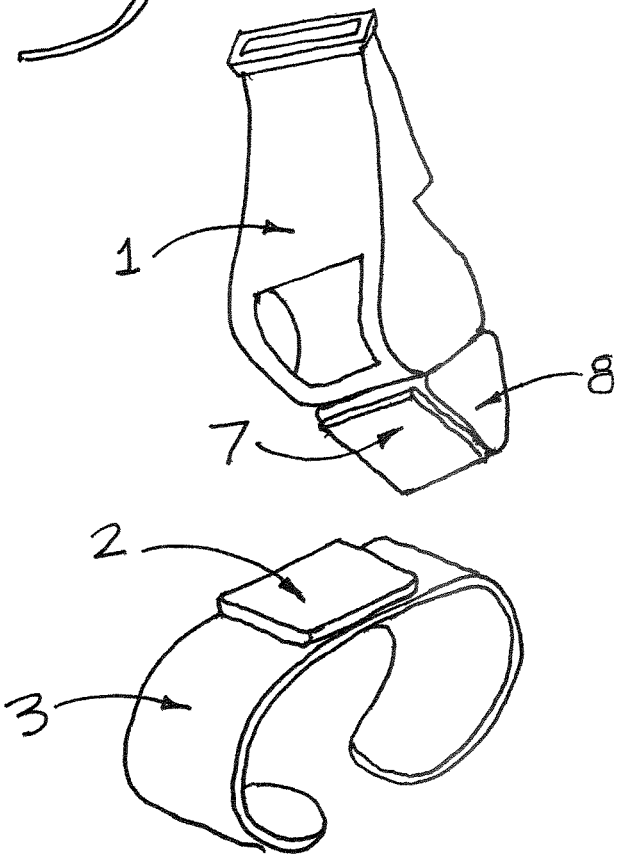
FIG. 9D is a perspective view of the embodiment of FIG. 9C.

FIGS. 9A-9E show embodiments comprising a magnetically attractive metallic component 7 attached to a separate base component 8 that is contoured to fit the configuration of the base of a whistle 1 or adapted to fit the base of an existing whistle. A sleeve 3 can include a permanently affixed magnet 2 for detachable coupling to the magnetically attractive metallic component 7. As shown in FIG. 9E, the intermediate base component 8 can also be configured to include a magnetically attractive metallic component 7*a* contoured to provide for docking the whistle in multiple directions. As shown in FIGS. 9A-9E, the intermediate base 8 can be permanently affixed to a whistle body 1 or the magnet can be integrated or cast into the body of the whistle component. The shape of the intermediate base 8 can be cast into the base form of a whistle or the whistle configured in a shape that includes a platform for mounting a magnet.

An adapter does not need to include a structural piece and a separate magnetic piece affixed together, as described for example in FIGS. 8A-9D. For example, any of the adapters 8 can comprise a one-piece adapter that is comprised or formed out of a magnet or magnetic material (e.g., ferrous metal) shaped in the form of an adapter for receiving a whistle.

Figure 10A:
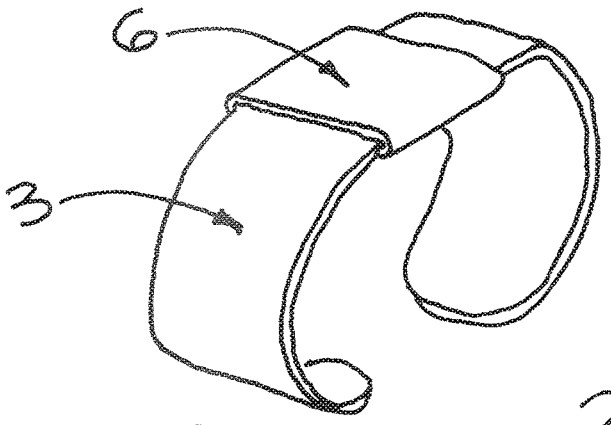
FIG. 10A is a perspective view of an embodiment having a non-magnetically attractive finger sleeve component with a permanently affixed or attached magnetically attractive metallic base component
Figure 10B:
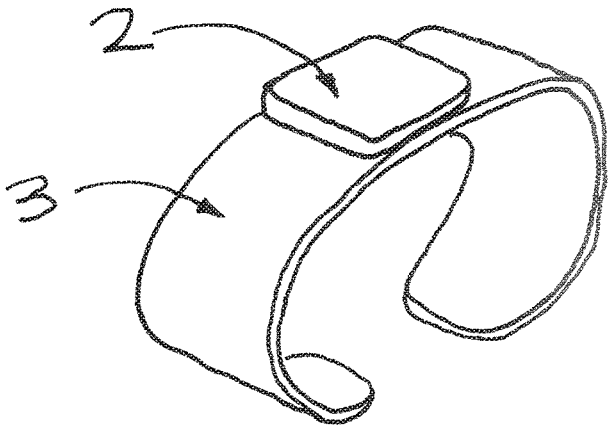
FIG. 10B is a perspective view of an embodiment having a non-magnetically attractive finger sleeve component with a permanently affixed or attached magnet.

FIG. 10A shows an embodiment comprising a magnetically attractive metallic component 6 permanently attached or affixed to a magnetically attractive or magnetically non-attractive metallic finger sleeve 3. The magnetically attractive metallic component 6 may be configured and/or contoured with a cavity and/or raised area to prevent the whistle from rotating and/or sliding from side to side. FIG. 10B shows an embodiment comprising a magnet 2 permanently attached or affixed to a magnetically attractive or magnetically non-attractive metallic or non-metallic finger sleeve 3.

Figure 10C:
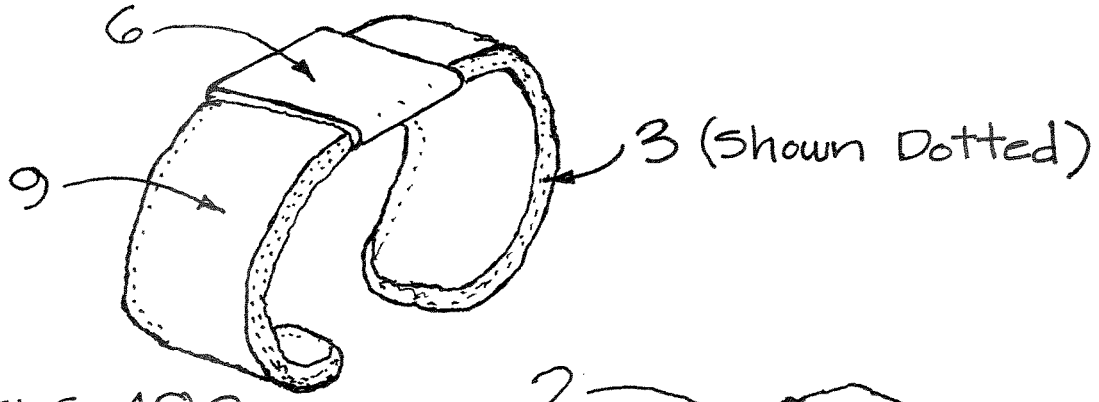
FIG. 10C is a perspective view of an embodiment having a non-magnetically attractive finger sleeve component with a permanently affixed or attached magnetically attractive metallic base component and with a cushioning material attached to the finger sleeve component.
Figure 10D:
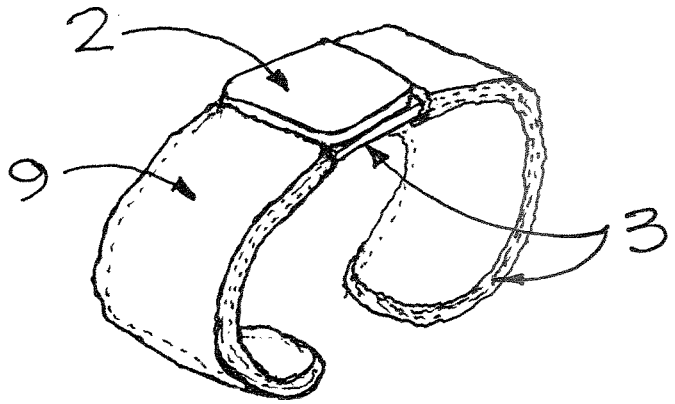
FIG. 10D is a perspective view of an embodiment having a non-magnetically attractive finger sleeve component with a permanently affixed or attached magnet and with a cushioning material attached to the finger sleeve component.
Figure 11:
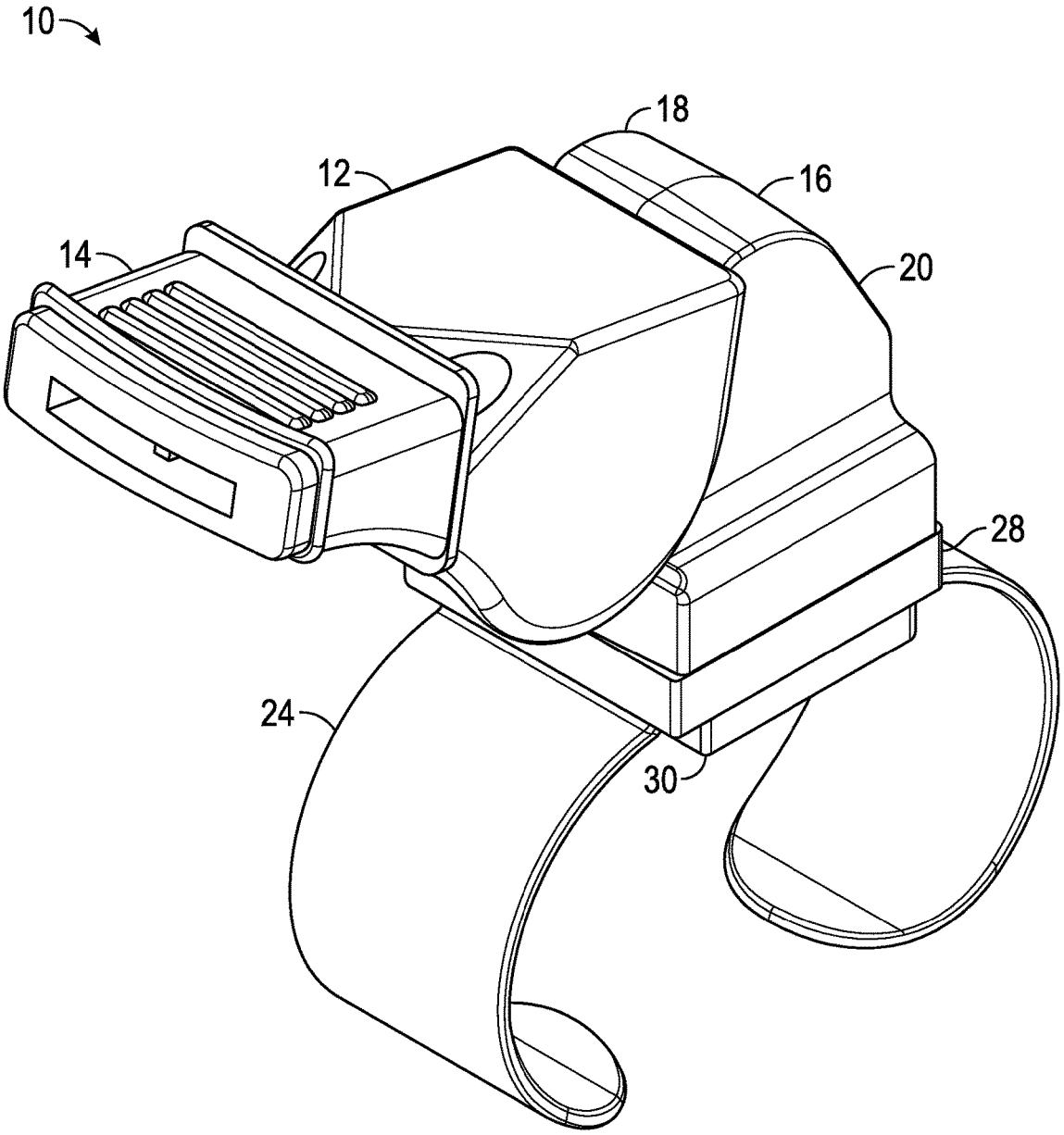
FIG. 11 is a perspective view of an exemplary detachable whistle assembly that includes magnetic elements that are encased in housing bases that serve to secure the magnetic elements to the respective components.

FIG. 10C shows an embodiment comprising a magnetically or non-magnetically attractive finger sleeve component 3 with a permanently affixed or attached magnetically attractive metallic base component 6 and with a cushioning material 9 (e.g., foam rubber, or any various synthetic elastomers, such as silicone rubber, etc.) attached to and/or covering the finger sleeve component. FIG. 10D shows an embodiment comprising a magnetically or non-magnetically attractive finger sleeve component 3 with a permanently affixed or attached magnet 2 and with a cushioning material 9 attached to the finger sleeve component.

A whistle can be attached to a magnet as shown in FIGS. 2A, 2B, and a separate magnet can also be attached to a sleeve, such as with an adhesive, mechanical, or integral method. A sleeve with the permanently attached magnet permits the use of a whistle with another magnet attached or the use of a magnetically attractive metal whistle without a magnet attached.

The whistle 1 may comprise a plastic "pea whistle" or a plastic "pea-less whistle" or a "metal whistle" or any number of other whistle types, materials, and shapes.

The magnet 2 may be round, square, rectangular, or other shape and if mechanically attached, may have a hole with a countersunk hole for a flat headed screw 5 or bolt, for flush mounting.

The finger sleeve 3 can comprise a metallic material that is attracted to a magnet (any ferrous metal, such as steel) or can comprise a non-magnetic material such as plastic or aluminum, or other material, and can include a permanently attached metallic base, as shown in FIG. 4A and FIG. 4B.

In some embodiments, a kit can be provided that comprises one or more components that can be used to detachably magnetically mount a conventional whistle to a sleeve. For example, a kit can include a sleeve component and a coupling component, where the coupling component is shaped or configured to receive a whistle (plastic, metal, or any type) in a permanent or semi-permanent manner. The coupling component can have a concavity to allow a whistle to snap-fit into the concavity, for example, or may comprise flexible material that can be stretched around the whistle to hold the whistle together with the coupling component, or adhesives or fasteners can be used to affix the coupling component to a whistle. The assembly can include a detachable magnetic interface between the sleeve component and the coupling component, as discussed in various embodiments herein, so that the whistle/coupling component subassembly can be repeatedly detached from and reattached to the sleeve component, such as by using one's teeth or lips while the sleeve remains on one's hand or fingers.

Embodiments with Encased or Enclosed Magnetic Members

In some embodiments, a detachable whistle assembly can comprise a whistle/whistle adapter component and a base component with each of the two components comprising encased or enclosed magnets and/or magnetically attractive components (collectively referred to as "magnetic members"). One or both of the magnetic members can comprise a magnet so that the two components are magnetically attracted to each other. Exemplary embodiments are shown in FIGS. 11-18.

In some embodiments, the whistle/whistle adaptor component of such an assembly can be fabricated with separate polymeric parts that are attached to a polymeric whistle or fabricated integrally as part of a polymeric whistle. In some embodiments, the whistle and the adaptor component that holds one of the magnetic member are integrally formed or are manufactured as a single unit. For example the whistle housing can include two halves that are fixed together during manufacturing, and the two halves can include a portion that forms a housing for one of the magnetic member, such that when the two halves are secured together they contain the magnetic member.

Figure 12:
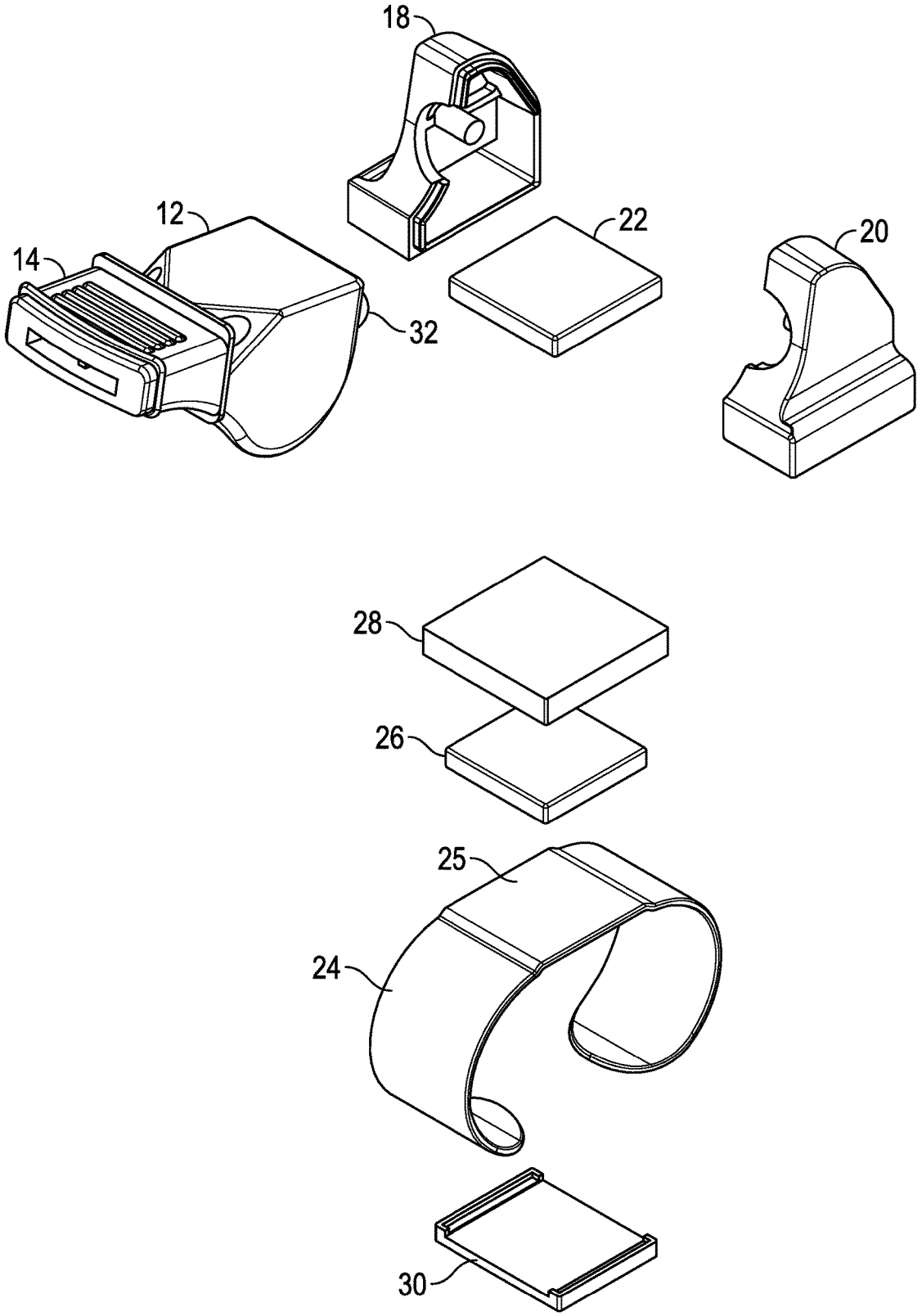
FIG. 12 is an exploded view of the detachable whistle assembly of FIG. 11.
Figure 13A:
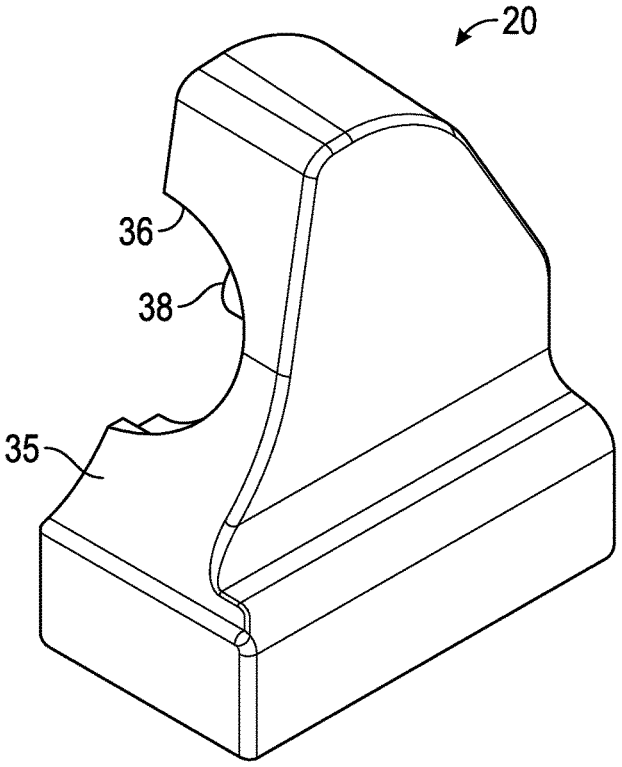
FIG. 13A is a perspective view of an adapter component of the detachable whistle assembly of FIG. 11.
Figure 13B:
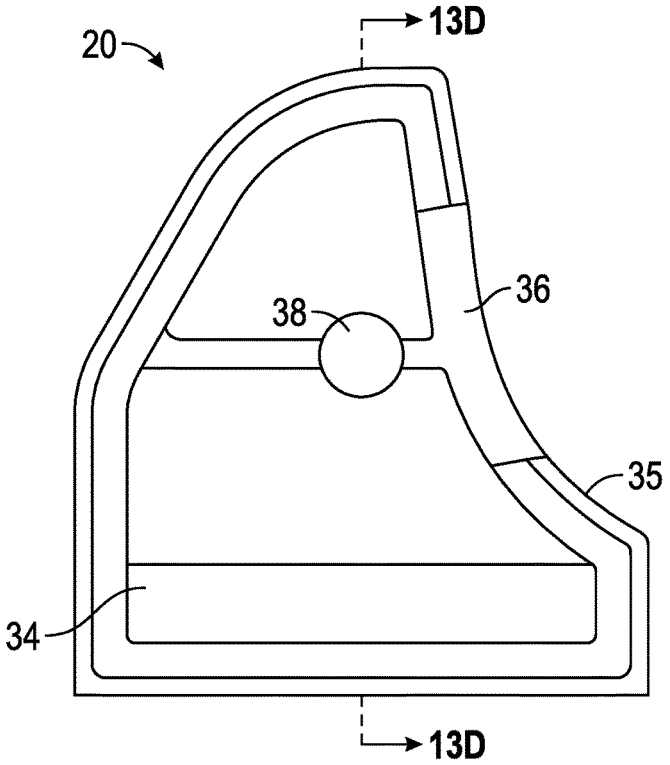
FIG. 13B is a side view of the adapter component of FIG. 13A, showing internal regions.
Figure 13C:
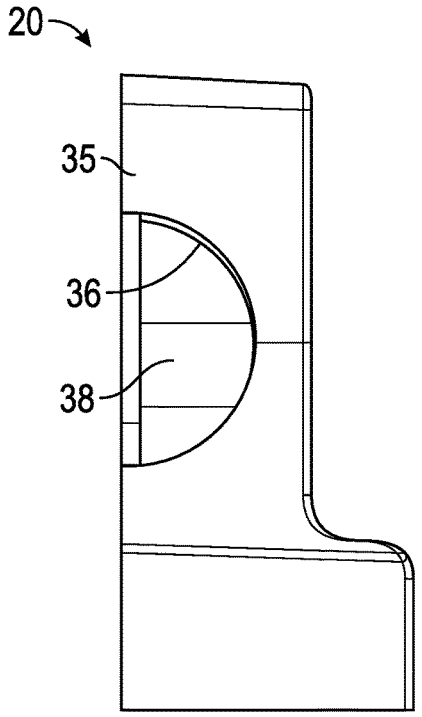
FIG. 13C is an end view of the adapter component of FIG. 13A, showing a surface that couples to a whistle.
Figure 13D:
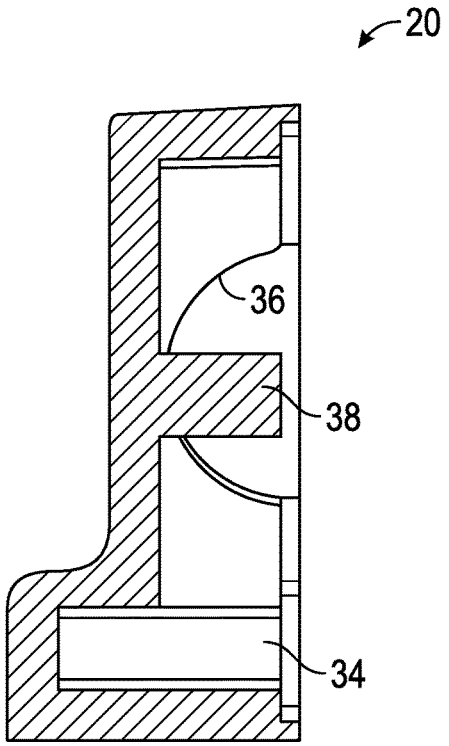
FIG. 13D is a cross-sectional view of the adapter component of FIG. 13A.
Figure 14A:
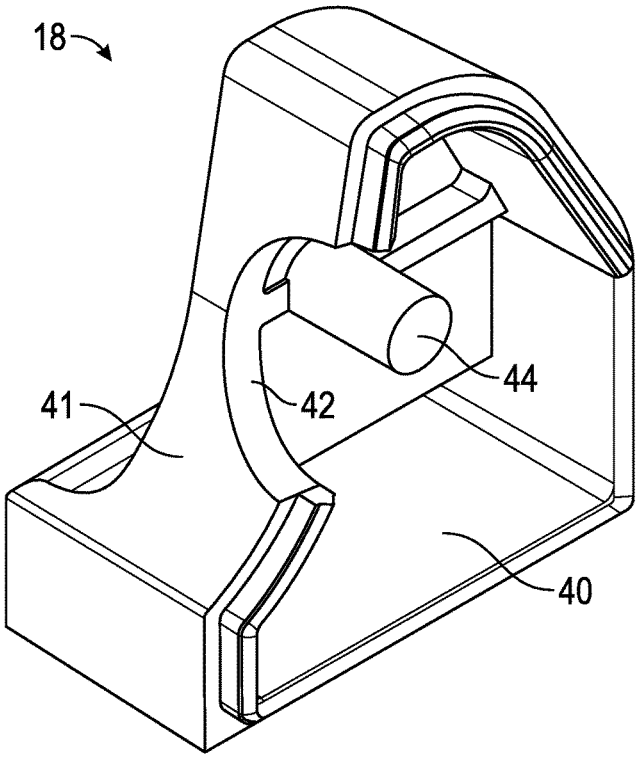
FIG. 14A is a perspective view of another adapter component of the detachable whistle assembly of FIG. 11.
Figure 14B:
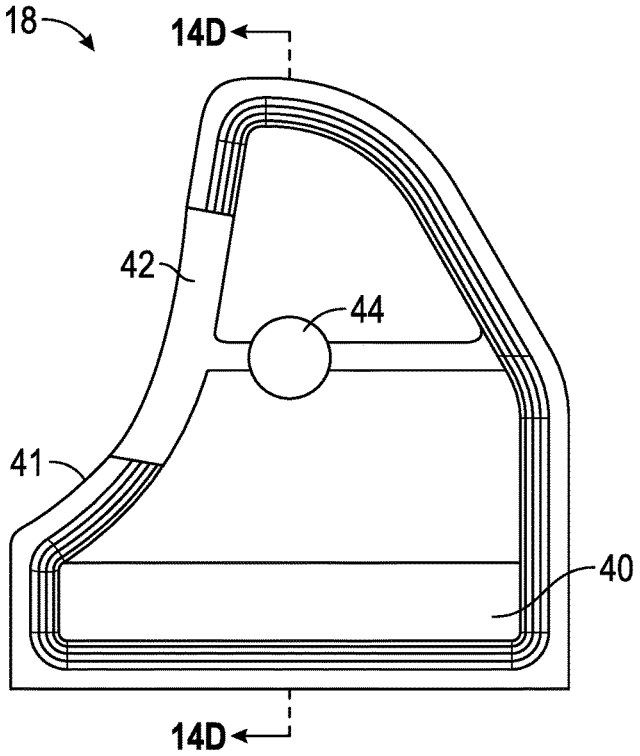
FIG. 14B is a side view of the adapter component of FIG. 14A, showing internal regions.
Figure 14C:
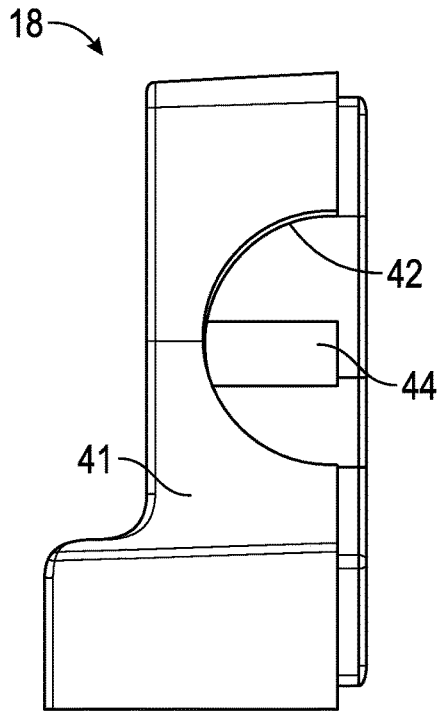
FIG. 14C is an end view of the adapter component of FIG. 14A, showing a surface that couples to a whistle.
Figure 14D:
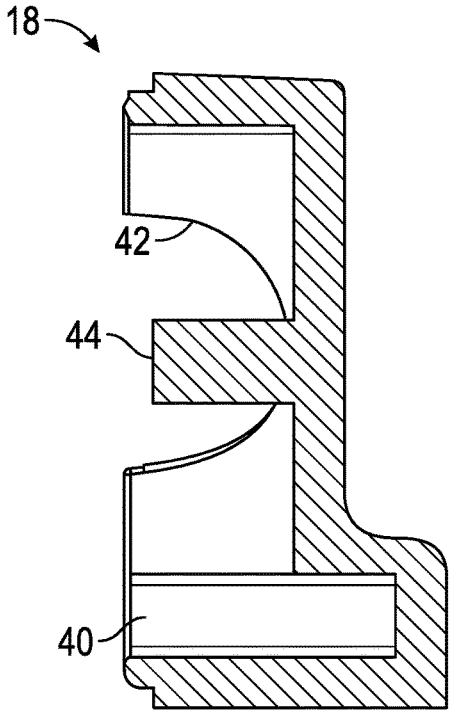
FIG. 14D is a cross-sectional view of the adapter component of FIG. 14A.

FIGS. 11-16C illustrate an exemplary detachable whistle assembly 10 that comprises a whistle 12 with mouthpiece 14, an adaptor or neck 16, and a finger sleeve base component 24. The adaptor 16 can be integral with the whistle 12 or a separate piece that is attached (e.g., with an adhesive or weld or fastener) to the whistle 12. As shown in FIGS. 12-14, the adaptor 16 in this embodiment comprises two parts 18 and 20 that join together to form an enclosed cavity 34/40 permitting the insertion of a magnetic member 22, either during the assembly of the parts or integrally during the whistle fabrication process. Inserting a magnetic member in the cavity 34/40 can improve assembly time and can eliminate the need for fasteners and/or adhesives to attach the magnetic member to the whistle neck and/or whistle.

The adapter parts 18 and 20 can have similar but mirrored shapes, as shown, or other complementary shapes to form the adaptor 16. The adapter part 20 (FIGS. 13A-13D) includes cavity 34, surface 35 for attaching to a surface of the whistle 12, opening 36 to allow insertion of a loop (e.g., loop 32 in FIG. 12) projecting from the whistle body, and peg 38 configured to extend through the loop 32. The adapter part 18 (FIGS. 14A-14D) includes cavity 40 that cooperates with the cavity 34 to house the magnetic member 22, surface 41 that cooperates with the surface 35 for attaching the adapter to a surface of the whistle 12, opening 42 that cooperates with opening 36 to allow insertion of the loop 32 of the whistle into the adapter, and peg 44 that cooperates with peg 38 to extend through the loop 32 and retain the whistle. The two parts 18 and 20 can be glued, welded, fastened, or otherwise attached together.

After assembly or fabrication of the whistle and adapter, the magnetic member 22 can be fully encased and not exposed, or can be only minimally exposed, to view or weathering elements. The magnetic member 22 inserted into the encased adapter 16 may or may not be visible, or can be only minimally visible, which can provide a unique and single material appearance.

Utilizing a magnetic member with a stronger or weaker pull force rating permits the force required for removing the whistle neck/whistle component from the base component to be increased or decreased. Variation in the thickness of the portion of the adapter 16 (e.g., bottom of parts 18 and 20) that is between the magnetic member 22 and the base component of the assembly can permit adjustment (increase or reduction) of the pull force required to remove the whistle from the base component, which can be limited when utilizing stronger or weaker magnets or with a direct magnet to magnet or magnet to magnetically attractive component design. Variation in the surface texture of the portion of the encasement that is between the magnetic member 22 and the base component of the assembly can permit adjustment of the horizontal and/or rotational movement of the whistle relative to the base which is not possible, or more difficult, with a direct magnet to magnet or magnet to magnetically attractive component design.

The base component 24 can be fabricated with one or more casing parts (e.g., casing parts 28 and 30 shown in FIG. 12, also shown in FIGS. 15 and 16) attached to a retaining elements, such as finger sleeve (e.g., element 25 in FIG. 12), or fabricated integrally with a retaining element. With either method of fabrication, the base component of the assembly can include a cavity permitting the insertion of a magnetic member (e.g., lower element 26 in FIG. 12) either during the assembly of the casing parts or integrally during the fabrication process of the base 24. Inserting the magnetic member in the cavity can improve assembly time and can eliminate or reduce the need for fasteners and/or adhesives to attach the magnetic member to the whistle neck and/or whistle.

Figure 15A:
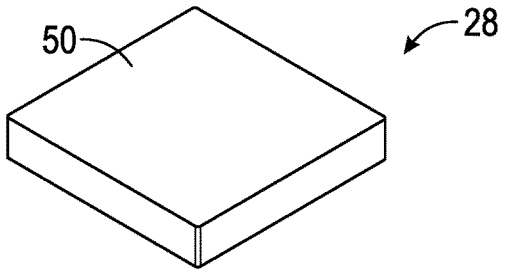
FIG. 15A is a perspective view of a magnet casing component for the detachable whistle assembly of FIG. 11.
Figure 15B:
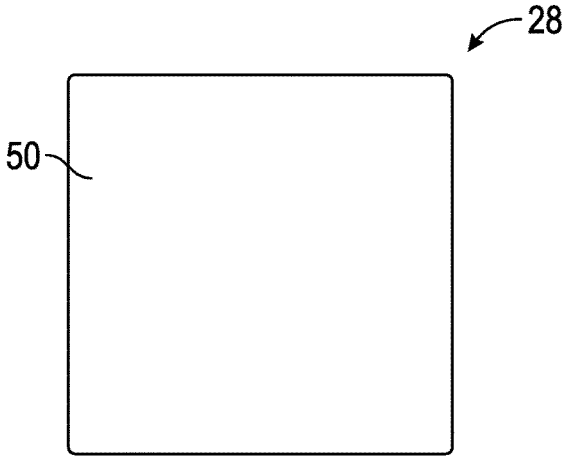
FIG. 15B is a top view of the casing component of FIG. 15A.
Figure 15C:
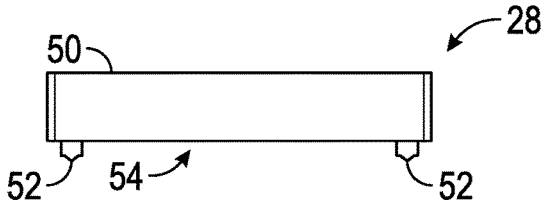
FIG. 15C is a side view of the casing component of FIG. 15A.
Figure 15D:
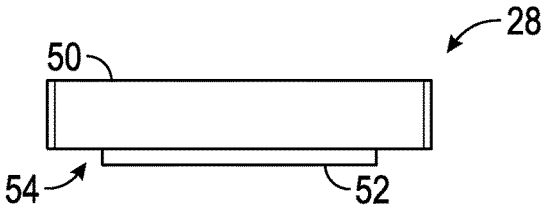
FIG. 15D is another side view of the casing component of FIG. 15A, orthogonal to the view of FIG. 15C.
Figure 16A:
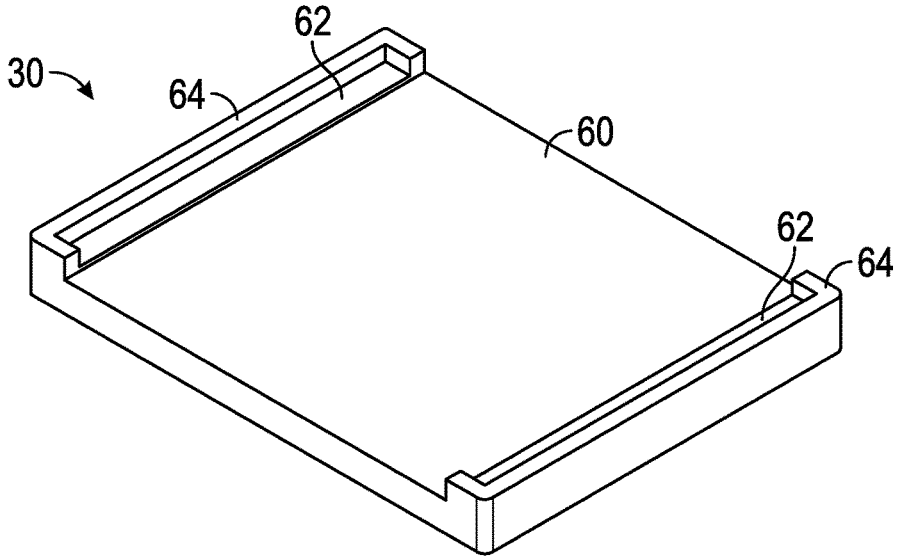
FIG. 16A is a perspective view of another magnet casing component for the detachable whistle assembly of FIG. 11.
Figure 16B:
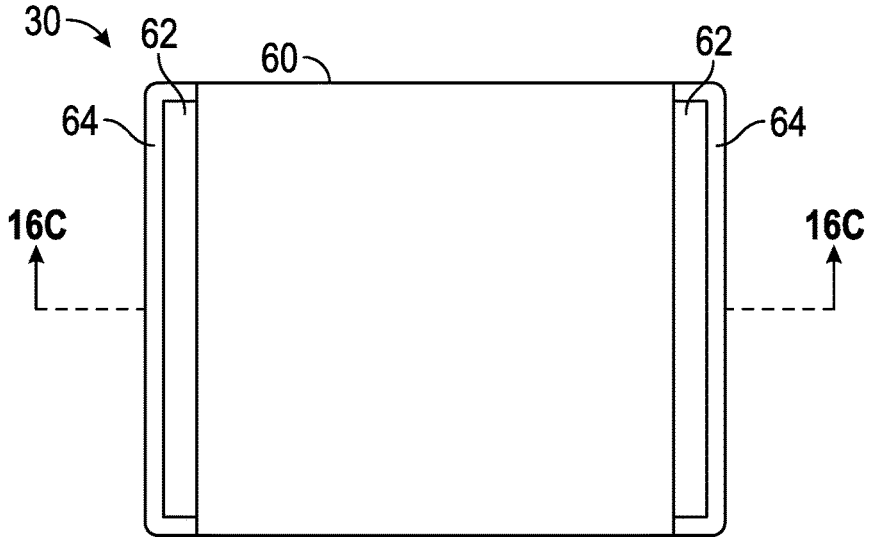
FIG. 16B is a top view of the casing component of FIG. 16A.
Figure 16C:
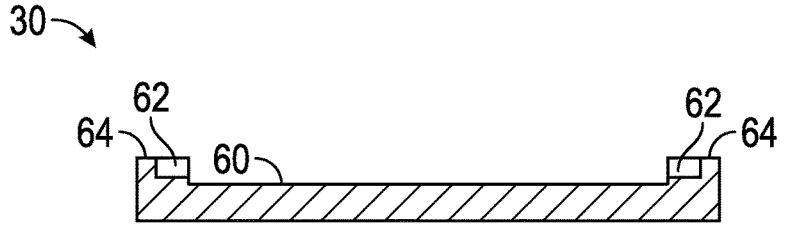
FIG. 16C is a side cross-sectional view of the casing component of FIG. 16A.

FIGS. 15A-15B illustrate an exemplary upper casing part 28 and FIGS. 16A-16C illustrate an exemplary lower casing part 30. The part 28 includes an upper mating surface 50 that contacts the lower surface the adapter 16, a lower recess 54 that receives the magnetic member 26, and ribs or projections 52 that extend down on the sides of the magnetic member and around the entrapped portion of the finger sleeve 25 or other retainer element. The lower part 30 includes an inner surface 60 that abuts the finger sleeve 25 and lateral walls 64 that form recesses 62 configured to matingly receive the projections 52 of the upper part 28 around the sides of the finger sleeve 25 and magnetic member 26. Together, the parts 28 and 30 sandwich the magnetic member and the finger sleeve 25 and secure them in place.

After assembly or fabrication of the base component 24, the magnetic member 26 may be fully encased and not exposed to view or weathering elements, or can be substantially encased and only minimally exposed. The magnetic member 26 inserted into the encased parts 28, 30 can be not visible or only minimally visible, which provides a unique and single material appearance.

Utilizing a magnet with a stronger or weaker pull force rating in the finger grip base can permit the force required for removing the whistle neck/whistle component from the base component to be increased or decreased. Variation in the thickness of the portion of the encasement (surface 50 of part 28) that is between the magnet of the base component and the whistle adapter component of the assembly can permit adjustment (increase or decrease) of the pull force required to remove the whistle from the base component which is limited with utilizing stronger or weaker magnets or direct magnet to magnet or magnet to magnetically attractive component design.

The whistle 12, adapter parts 18 and 20, and/or casing parts 28 and 30 can comprise polymeric material, metallic material, and/or other sufficiently strong and suitable materials.

Variation in the surface texture of the portion of the encasement that is between the magnetic member of the base component and the whistle neck component of the assembly can permit adjustment of the horizontal and/or rotational movement of the whistle neck component relative to the base component which is not possible or is more difficult with a direct magnet to magnet or magnet to magnetically attractive component design.

Figure 17A:
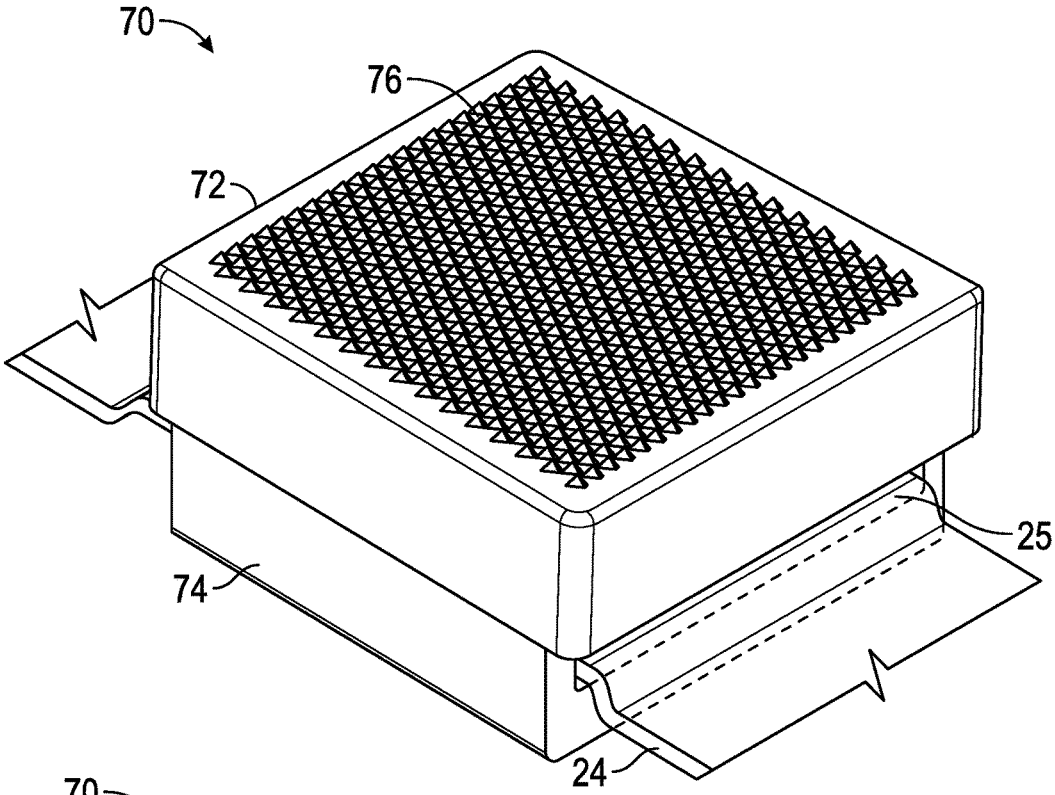
FIGS. 17A-17C illustrate an embodiment of a finger sleeve base component including a knurled upper surface of the finger sleeve base.
Figure 17B:
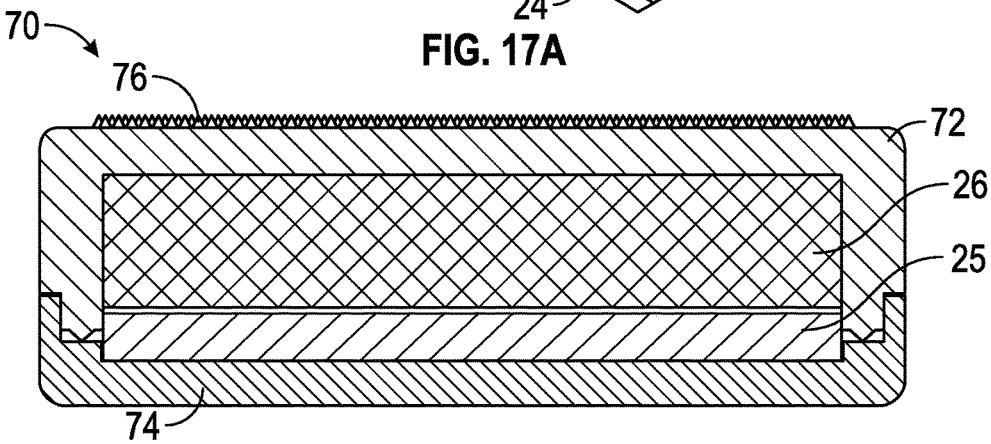
Figure 17C:
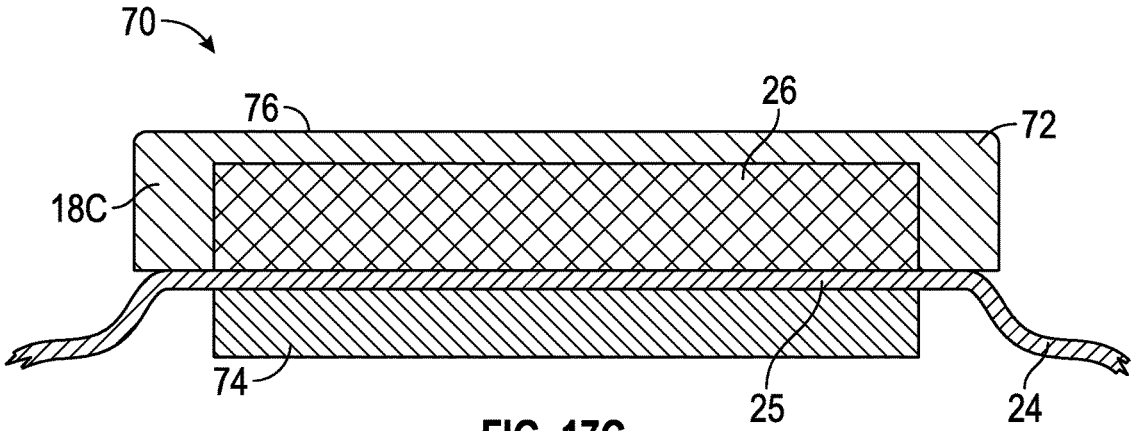

For example, FIGS. 17A-17C show an exemplary finger grip base 70 that includes an upper base component 72 having a knurled pattern 76 that separates the magnetic member 26 inside the finger grip portion from the removable portion of the assembly (e.g., the whistle 12 and the adapter 16). A lower base component 74 mates with the upper component 72 to secure the magnetic member 26 to the finger grip 25.

Figure 18A:
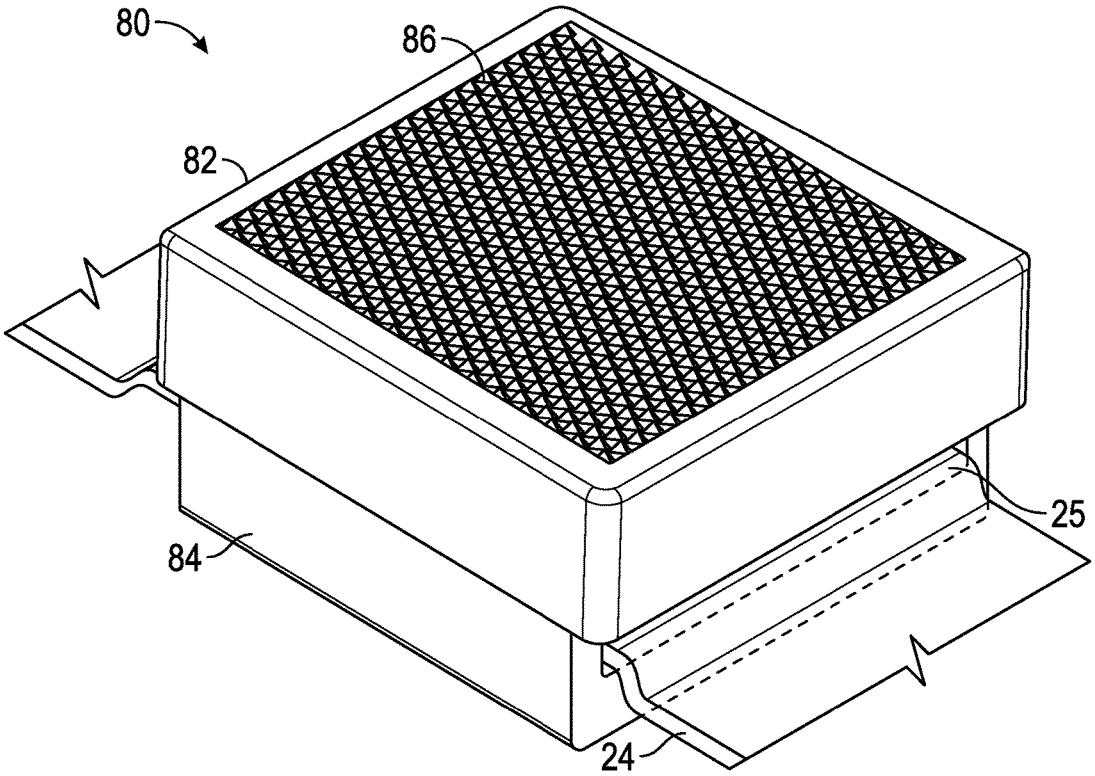
FIGS. 18A-18C illustrate an embodiment of the finger sleeve base component including a textured insert positioned at the upper surface of the finger sleeve base.
Figure 18B:
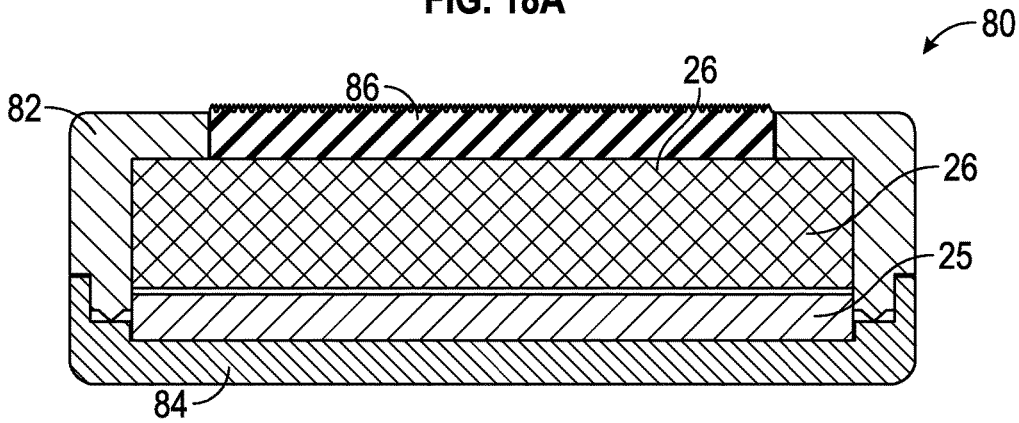
Figure 18C:
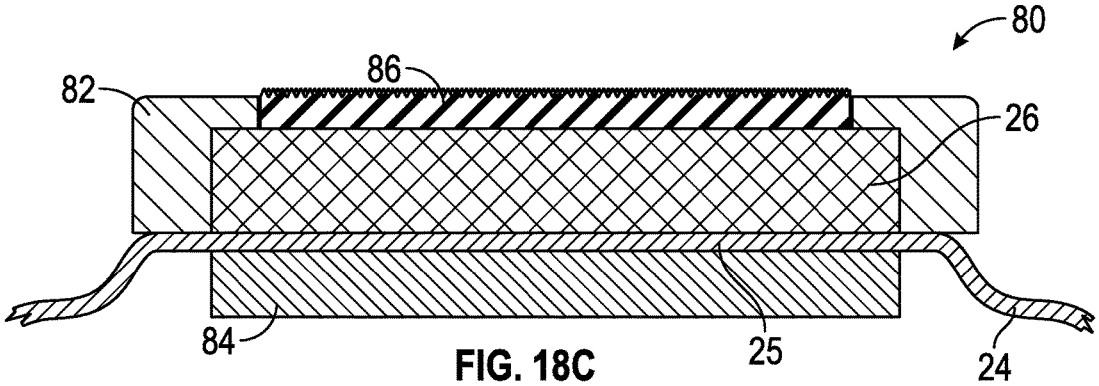

FIGS. 18A-18C show another exemplary finger grip base 80 that includes a lower base component 84 and an upper base component 82 that curls around the upper edges of the magnetic member 26 and forms an upper opening above the magnetic member that receives a textured insert 86, such as comprising a soft rubber or other similar material. The textured soft insert 86 separates the magnetic member 26 inside the finger grip portion 80 from the removable portion of the assembly (e.g., the whistle 12 and the adapter 16). In addition to limiting the horizontal and/or rotational movement of the removable portion, the insert 86 can serve to cushion the force of the attachment and reduce noise associated with attachment. The insert 86 can be attached directly to the magnetic member and/or attached to the curled upper edges of the upper base portion 82.

While both the base component and the whistle/adapter component of the detachable whistle assembly with encased or enclosed magnetic member are desirably used together, it is possible and within the scope of this disclosure for the two detachable components to be used separately with any other variations of a detachable whistle design that include an exposed magnetic member.

GENERAL CONSIDERATIONS

The various embodiments disclosed herein are only examples and do not limit the scope of the disclosure, as various equivalent embodiments not specifically disclosed are also contemplated as within the scope of this disclosure. For purposes of this description, certain aspects, advantages, and novel features of the embodiments of this disclosure are described. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A," "B," "C," "A and B," "A and C," "B and C" or "A, B and C." As used herein, the term "coupled" generally means physically coupled or linked and does not exclude the presence of intermediate elements between the coupled or associated items absent specific contrary language.

In view of the many possible embodiments to which the disclosed principles may be applied, it should be recognized that the illustrated embodiments are only preferred examples and should not be taken as limiting the scope of the disclosure. Rather, the scope of the disclosure is at least as broad as the following claims. I therefore claim as my invention all that comes within the scope of these claims.

The invention claimed is:

1. An assembly comprising:

a whistle component comprising a first magnetic member; and a base component comprising a second magnetic member;

wherein at least one of the first and second magnetic members comprises a magnet such that the first and second magnetic members are magnetically attracted to each other;

wherein the whistle component is magnetically coupled to the base component, and the whistle component is detachable from the base component by breaking a magnetic bond between the first and second magnetic members and re-attachable to the base component via a magnetic bond between the first and second magnetic members; and wherein the base component comprises a retainer for holding the assembly and a casing that secures the second magnetic member to the retainer.

2. The assembly of claim 1, wherein the whistle component comprises a whistle and a casing that secures the first magnetic member to the whistle.

3. The assembly of claim 1, wherein the whistle component comprises a whistle body and the first magnetic member is secured to the whistle body.

4. The assembly of claim 1, wherein the whistle component comprises an adaptor and a whistle attached together.

5. The assembly of claim 4, wherein the adaptor comprises an internal cavity and the first magnetic member is positioned in the internal cavity.

6. The assembly of claim 4, wherein the adaptor comprises an internal peg that extends through a loop of the whistle.

7. The assembly of claim 4, wherein the adaptor comprises a thin polymeric wall that covers the first magnetic member from the base component.

8. The assembly of claim 1, wherein the casing that secures the second magnetic member to the retainer allows the first and second magnetic members to be in direct contact when the whistle component is magnetically coupled to the base component.

9. The assembly of claim 1, wherein the casing comprises a non-magnetic material that separates the second magnetic member from the whistle component when the whistle component is magnetically coupled to the base component.

10. The assembly of claim 1, wherein the casing includes a wall that separates the second magnetic member from the whistle component when the whistle component is magnetically coupled to the base component.

11. The assembly of claim 1, wherein the casing comprises a lower part positioned below the second magnetic member and the retainer and an upper part positioned above the second magnetic member and the retainer, wherein the lower part is secured to the upper part to retain the second magnetic member to the retainer.

12. The assembly of claim 1, wherein the retainer comprises a finger grip.

13. The assembly of claim 1, wherein the retainer comprises a non-magnetic material.

14. The assembly of claim 10, wherein the wall that separates the second magnetic member from the whistle component comprises a textured surface that contacts the whistle component, wherein the textured surface provides increased friction between the whistle component and the base component to resist movement therebetween.

15. The assembly of claim 14, wherein the textured surface comprises an upper wall of a casing that secures the second magnetic member to a retainer.

16. The assembly of claim 10, wherein the wall comprises an insert that has a textured surface that contacts the whistle component, wherein the insert is made of a different material that the rest of the casing.

17. The assembly of claim 1, wherein the whistle component comprises an adaptor and a whistle integrally formed together as a monolithic body.

18. The assembly of claim 17, wherein the first magnetic member is retained by the adaptor.

19. The assembly of claim 1, wherein the retainer extends between the casing and the second magnetic member.

* * * * *